US011772868B2

(12) United States Patent
Tanaka et al.

(10) Patent No.: US 11,772,868 B2
(45) Date of Patent: Oct. 3, 2023

(54) POUCH AND POUCH MANUFACTURING METHOD

(71) Applicant: Toyo Seikan Co., Ltd., Tokyo (JP)

(72) Inventors: Hiroki Tanaka, Yokohama (JP); Takahiro Yasuumi, Yokohama (JP); Takahiro Kurosawa, Yokohama (JP); Masahiro Takenaka, Yokohama (JP)

(73) Assignee: TOYO SEIKAN CO., LTD., Tokyo (JP)

( * ) Notice: Subject to any disclaimer, the term of this patent is extended or adjusted under 35 U.S.C. 154(b) by 0 days.

(21) Appl. No.: 17/398,125

(22) Filed: Aug. 10, 2021

(65) Prior Publication Data

US 2021/0362928 A1 Nov. 25, 2021

Related U.S. Application Data

(63) Continuation of application No. PCT/JP2020/005228, filed on Feb. 12, 2020.

(30) Foreign Application Priority Data

Feb. 15, 2019 (JP) ..... 2019-025347
Jun. 14, 2019 (JP) ..... 2019-110868

(51) Int. Cl.
*B65D 75/00* (2006.01)
*B65D 75/56* (2006.01)
*B65D 75/58* (2006.01)

(52) U.S. Cl.
CPC ..... *B65D 75/008* (2013.01); *B65D 75/563* (2013.01); *B65D 75/5872* (2013.01)

(58) Field of Classification Search
CPC . B65D 75/008; B65D 75/563; B65D 75/5872
(Continued)

(56) References Cited

U.S. PATENT DOCUMENTS 4,696,403 A * 9/1987 Hoover ..... B29C 66/1122 206/428
4,786,275 A * 11/1988 Hoover ..... B29C 66/43121 493/203

(Continued)

FOREIGN PATENT DOCUMENTS

CN 1774371 A 5/2006
JP 2000-272670 A 10/2000

(Continued)

OTHER PUBLICATIONS

Office Action dated Jun. 9, 2022, issued in counterpart CN Application No. 202080013500.2, with English Translation. (17 pages).

(Continued)

*Primary Examiner* — Peter N Helvey
(74) *Attorney, Agent, or Firm* — WHDA, LLP

(57) ABSTRACT

To provide a pouch for achieving a reduced storage space with a simple configuration and a method for manufacturing the pouch. A pouch (10) including a gusset portion (22) includes a pouch main body (20) and an inner supporting member (70) disposed inside the pouch main body (20). The pouch main body (20) includes a content containing portion (21) and a first fixture portion (24) and a second fixture portion (25) that face each other across the content containing portion (21). The inner supporting member (70) includes a first fixing portion (71) fixed to the first fixture portion (24) and a second fixing portion (72) fixed to the second fixture portion (25).

17 Claims, 25 Drawing Sheets

(58) Field of Classification Search
USPC ..... 383/104
See application file for complete search history.

(56) References Cited

U.S. PATENT DOCUMENTS

| | | | | |
|---|---|---|---|---|
| 5,137,154 | A * | 8/1992 | Cohen | B65D 33/02 426/414 |
| 5,353,927 | A * | 10/1994 | Stupar | B65D 81/3266 206/219 |
| 5,492,219 | A * | 2/1996 | Stupar | B65D 81/3266 206/219 |
| 6,164,492 | A * | 12/2000 | Lane | B65D 83/625 222/394 |
| 2004/0004010 | A1* | 1/2004 | Versluys | B65D 81/3261 206/219 |
| 2004/0234175 | A1 | 11/2004 | Takita et al. | |
| 2010/0113240 | A1 | 5/2010 | Takita et al. | |
| 2014/0370160 | A1* | 12/2014 | Martin | B32B 27/36 426/106 |
| 2015/0158635 | A1* | 6/2015 | Gum | B65D 75/008 383/38 |
| 2016/0159526 | A1* | 6/2016 | Kessler, Jr. | B65D 33/065 493/227 |
| 2019/0152669 | A1 | 5/2019 | Tiwari et al. | |

FOREIGN PATENT DOCUMENTS

| | | | |
|---|---|---|---|
| JP | 3150520 | U | 5/2009 |
| JP | 2012-121611 | A | 6/2012 |
| JP | 3213446 | U | 11/2017 |
| WO | 2018/005116 | A1 | 1/2018 |

OTHER PUBLICATIONS

International Search Report dated Apr. 21, 2020, issued in counterpart International Application No. PCT/JP2020/005228 (2 pages).

* cited by examiner

POUCH AND POUCH MANUFACTURING METHOD

TECHNICAL FIELD

The present invention relates to a pouch including a gusset portion, and a pouch manufacturing method.

BACKGROUND ART

In the related art, a bag-shaped pouch formed from a resin film is known as a container that contains a fluid content, such as drinking water (see Patent Document 1, for example).

Further, also as disclosed in Patent Document 1, a method is also known in which, during use (during dispensing of the contents) or during display, transportation, and the like of the pouch, the pouch is utilized in a so-called back-in-box format, that is, the pouch is contained in an outer case and then utilized.

CITATION LIST

Patent Literature

Patent Document 1: JP 2012-121611 A

SUMMARY OF INVENTION

Technical Problem

However, the resin film constituting such a pouch is flexible, and therefore, particularly when forming a large volume pouch, so-called body bulging, in which bulging occurs in a lower portion of a pouch main body, may occur as a result of the weight of the fluid content, such as the drinking water or the like.

Then, when the body bulging described above occurs, it is necessary to secure a large storage space for the pouch during use or during display, transportation, and the like of the pouch. Further, when utilizing the pouch in the bag-in-box format, it is necessary to strengthen the outer case, taking the body bulging of the pouch into account.

Here, it is an object of the present invention to solve these problems, and to provide a pouch for achieving a reduced storage space with a simple configuration and a method for manufacturing the pouch.

Solution to Problem

The pouch of the present invention is a pouch including a gusset portion, and is intended to solve the aforementioned problems by including a pouch main body and an inner supporting member disposed inside the pouch main body. The pouch main body includes a content containing portion, and a first fixture portion and a second fixture portion facing each other across the content containing portion. The inner supporting member includes a first fixing portion fixed to the first fixture portion and a second fixing portion fixed to the second fixture portion.

Further, a pouch manufacturing method of the present invention is a method for manufacturing a pouch including an inner supporting member disposed inside a pouch main body, and is intended to solve the aforementioned problems by including a step of disposing the inner supporting member formed from a resin film between a front side film and a rear side film constituting the pouch main body, with the inner supporting member being folded in two, and, by clamping the front side film, the rear side film, and the inner supporting member using a thermal fusing jig, thermally fusing a partial region between facing surfaces of the front side film and the inner supporting member and thermally fusing a partial region between facing surfaces of the rear side film and the inner supporting member. In the step, a baffle plate is disposed between inner side surfaces of the inner supporting member that is folded in two.

Advantageous Effects of Invention

According to one embodiment of the invention, the inner supporting member can prevent the first fixture portion and the second fixture portion of the pouch main body, which face each other across the content containing portion, from separating from each other, and this can maintain the overall shape of the pouch containing the contents and suppress so-called body bulging in which bulging occurs in a lower portion of the pouch main body due to the weight of the fluid contents, such as drinking water or the like. In this way, along with achieving a reduced storage space for the pouch during use or during display, transportation, and the like of the pouch, when the pouch is utilized in a bag-in-box format, it is possible to eliminate the need for imparting a high degree of strength to an outer case housing the pouch.

According to another embodiment of the invention, since the inner supporting member includes a circulation portion having a hole shape or a cutout shape and configured to allow contents to circulate, even when the inner supporting member is installed so as to partition the interior of the content containing portion into a plurality of spaces, it is possible to secure a flow of the contents inside the content containing portion, and thus, favorable dispensing of the contents can be maintained.

According to another embodiment of the invention, since the first fixing portion and the second fixing portion can be fixed to the pouch main body by the thermal fusing that is also used when forming the pouch main body, a manufacturing burden can be reduced.

According to another embodiment of the invention, in a sealing portion configured to allow the pouch main body to be formed in a bag-like shape, at least one of the first fixing portion or the second fixing portion is disposed between a front side film and a rear side film, and is thermally fused to the front side film and the rear side film. In this way, the first fixing portion or the second fixing portion can be fixed to both the front side film and the rear side film, and a fixing strength of the first fixing portion or the second fixing portion with respect to the pouch main body can be improved. Not only this, the forming of the sealing portion configured to allow the pouch main body to be formed in a bag-like shape and the fixing of the first fixing portion or the second fixing portion with respect to the pouch main body can be performed at the same time, and thus, a manufacturing burden can be reduced. Further, since the strength is increased at a section at which the first fixing portion or the second fixing portion is disposed between the front side film and the rear side film, during use or during display or transportation, by placing the pouch on a placement surface with the section at which the first fixing portion or the second fixing portion is disposed between the front side film and the rear side film being on the lower side, self-supporting characteristics of the pouch can also be improved.

According to another embodiment of the invention, since at least one of the first fixing portion or the second fixing portion is, in a state of being folded in two such that the thermal fusing layer faces the front side film and the rear side film, disposed between the front side film and the rear side film, it is possible to eliminate the need for forming the thermal fusing layer on both surfaces of the resin film constituting the inner supporting member, and further, the strength can be further increased at the section at which the first fixing portion or the second fixing portion is disposed between the front side film and the rear side film.

According to another embodiment of the invention, since at least a part of a handle hole formed in the sealing portion is formed extending through a section where the front side film, the rear side film, and the first fixing portion overlap, and this can secure sufficient strength of edge portions of the handle hole, it is possible to suppress the occurrence of deformation or rupture of the edge portions of the handle hole.

According to another embodiment of the invention, since the inner supporting member can prevent the third fixture portion and the fourth fixture portion of the pouch main body, which face each other across the content containing portion, from separating from each other, the overall shape of the pouch containing the contents can be more reliably maintained.

According to another embodiment of the invention, in the sealing portion configured to allow the pouch main body to be formed in a bag-like shape, the first fixing portion and the second fixing portion are, in a state of being folded in two such that the thermal fusing layer faces the front side film and the rear side film, disposed between the front side film and the rear side film, and are thermally fused to the front side film and the rear side film. The third fixing portion is thermally fused to an inner side surface of the front side film, and the fourth fixing portion is thermally fused to an inner side surface of the rear side film. In this way, the thermal fusing of the first to fourth fixing portions with respect to the pouch main body can be performed at the same time, and further, the forming of the sealing portion configured to allow the pouch main body to be formed in a bag-like shape and the thermal fusing of the first to fourth fixing portions with respect to the pouch main body can be performed at the same time.

According to another embodiment of the invention, since the first fixing portion is fixed to the inner side surface of the front side film, and the second fixing portion is fixed to the inner side surface of the rear side film, and this can prevent the front side film and the rear side film from separating from each other, it is possible to maintain the overall shape of the pouch containing the contents, and to suppress the so-called body bulging.

According to another embodiment of the invention, a gusset film is disposed between the front side film and the rear side film in a state of being folded in two with a folded over portion of the gusset film directed toward the content containing portion, and, at at least one of both end portions in a lengthwise direction of the gusset film, the gusset film is folded diagonally with respect to the lengthwise direction, such that a corner portion of the gusset film positioned on a side of the content containing portion approaches the outside of the pouch main body. In this way, by disposing the spout in an open space that is obtained by folding the gusset film diagonally, it is possible to dispose the spout close to an end, and thus, when using the pouch, it is possible to allow the spout to be positioned at a lower position and to suppress the fact that a large amount of the contents remains inside the pouch.

According to another embodiment of the invention, at a predetermined location of a film constituting the pouch main body, a creased portion configured to allow folding to more easily occur by deforming the film into a projection-recess shape in a thickness direction of the film is formed. In this way, the film can be bent at the predetermined location, and the overall shape of the pouch can be caused to be a shape suitable for storage, display and the like. Thus, the storability and display ability of the pouch can be improved.

According to another embodiment of the invention, since the handle hole formed in the sealing portion is formed at a position where the handle hole is hooked on the spout in a case where the films are bent at the creased portion, and this allows the overall shape of the pouch to be a shape suitable for storage, display and the like, the storability and display ability of the pouch can be improved.

According to another embodiment of the invention, since a weakened portion having a weaker strength than a strength of a peripheral section is formed at the inner supporting member itself or a fixing portion between the pouch main body and the inner supporting member, when the pouch is dropped or the like, as a result of the weakened portion breaking or becoming damaged, it is possible to leave a record, on the pouch, of the pouch being dropped or the like. Further, even when the inner supporting member itself or the fixing portion between the pouch main body and the inner supporting member is broken or becomes damaged, since this is not a section that leads to leakage of the contents or the like, the record of the pouch being dropped can be caused to remain on the pouch without the leakage of the contents occurring.

According to another embodiment of the invention, since a fluid containing portion containing a fluid in an encapsulated state is formed at a fixing region between the film constituting the pouch main body and the film constituting the inner supporting member, the self-supporting characteristics of the pouch can be improved, for example, that is, shape maintainability of the pouch can be improved.

According to another embodiment of the invention, since the inner supporting member is configured to divide the content containing portion into a plurality of spaces, and the inner supporting member is formed with a circulation portion configured to allow the plurality of spaces to communicate with each other, by adjusting a formation position of the circulation portion, it is possible to rectify a flow of the contents when the pouch is filled with the contents and to suppress foaming. It is thus possible to improve filling efficiency of the contents into the pouch.

According to another embodiment of the invention, since a penetration slit extending through films constituting the pouch main-body in a front-rear direction and a handle tab divided from a peripheral section by the penetration slit are formed in the sealing portion formed by thermally fusing the films, and part of an outer edge of the handle tab is connected to the peripheral section by a folding connection portion, when lifting the pouch, fingers of a user can be caused to come into contact with the film folded in the vicinity of the folding connection portion, and thus, it is possible to avoid causing pain in the fingers of the user.

According to another embodiment of the invention, since the inner supporting member is installed to completely separate the content containing portion into a plurality of spaces, it is possible to contain different contents in the plurality of spaces inside the content containing portion. Various usage modes can be realized, such as selecting and dispensing the contents in accordance with the wishes of the user, or changing the color and fragrance of the contents to be used by dispensing and blending two or more types of the contents.

According to another embodiment of the invention, since a hanging portion configured to allow the pouch to be suspended and used is formed at the pouch main body, and a spout is attached at a position that is a lower side of the pouch in a state where the pouch is suspended using the hanging portion, an amount of the contents remaining in the content containing portion can be reduced.

According to another embodiment of the invention, a pouch manufacturing method includes a step of disposing an inner supporting member formed from a resin film between a front side film and a rear side film constituting a pouch main body, with the inner supporting member being folded in two, and, by clamping the front side film, the rear side film, and the inner supporting member using a thermal fusing jig, thermally fusing a partial region between facing surfaces of the front side film and the inner supporting member and thermally fusing a partial region between facing surfaces of the rear side film and the inner supporting member. In the step, a baffle plate is disposed between inner side surfaces of the inner supporting member that is folded in two. In this way, while avoiding inner side surfaces of the inner supporting member that is folded in two from becoming thermally fused to each other, the inner supporting member can be thermally fused to the front side film and the rear side film at the same time, and thus, the manufacturing burden can be reduced.

According to another embodiment of the invention, the inner supporting member is thermally fused to the front side film and the rear side film simultaneously with forming of the sealing portion configured to allow the pouch main body to be formed in a bag-like shape, and this can further reduce the manufacturing burden.

DESCRIPTION OF EMBODIMENTS

A pouch 10 according to a first embodiment of the present invention will be described below with reference to the drawings.

Figure 1:
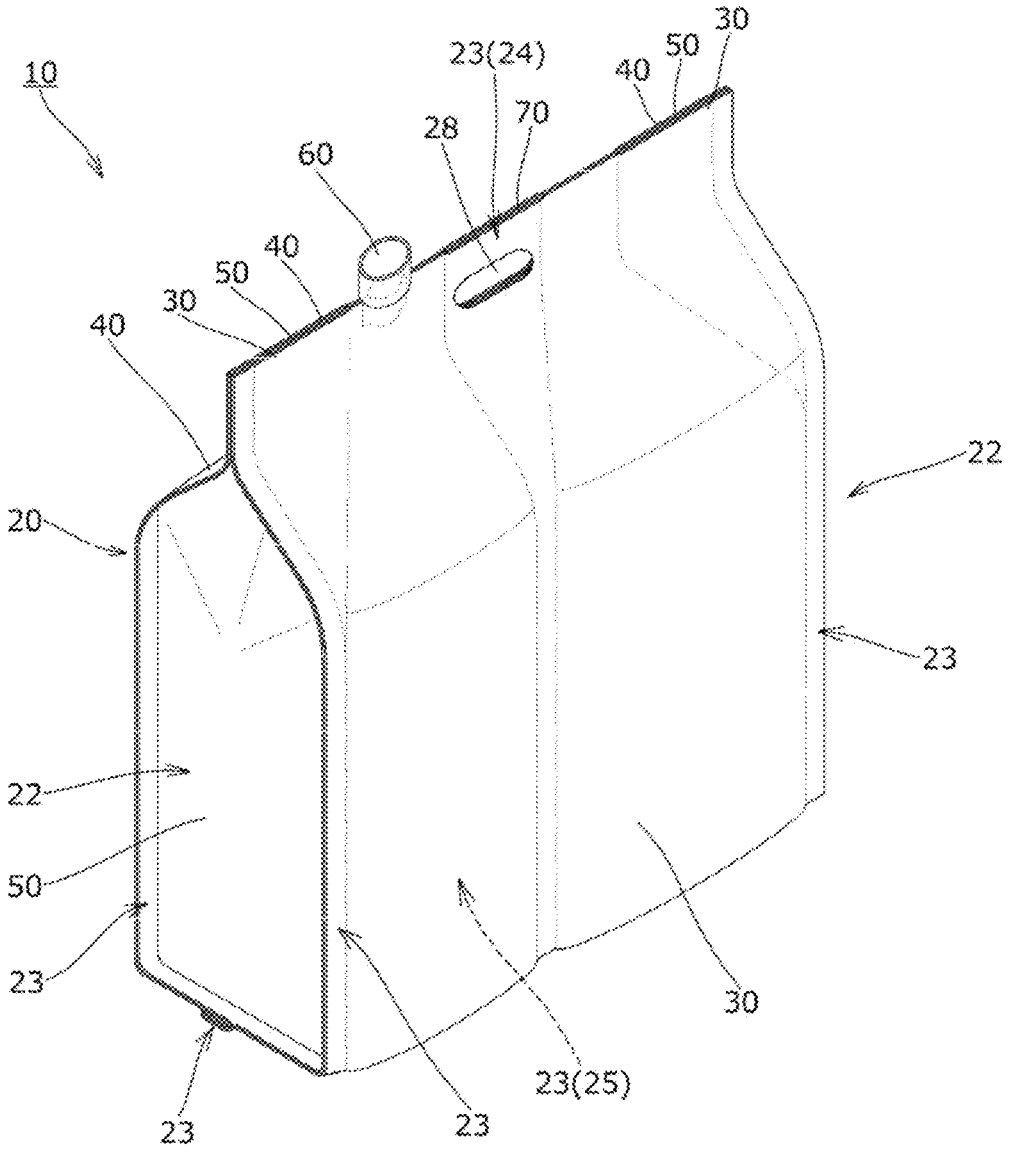
FIG. 1 is a perspective view illustrating a pouch according to a first embodiment of the present invention.

The pouch 10 contains a fluid content, such as a liquid detergent, and, as illustrated in FIG. 1, includes a pouch main body 20 formed in a bag-like shape from a flexible resin film, a spout 60 attached to the pouch main body 20, and an inner supporting member 70 disposed inside the pouch main body 20. The pouch 10 is housed and utilized in an outer case (not illustrated) during use or during display or transportation thereof.

The pouch main body 20 is formed in the bag-like shape by forming sealing portions 23 at which a front side film 30, a rear side film 40, and a pair of gusset films 50 are thermally fused surrounding a content containing portion 21. In the present embodiment, as illustrated in FIG. 1, the pouch main body 20 is configured as a so-called side-gusseted pouch in which gusset portions 22 are formed on both of the side portions.

Each of the films 30, 40, and 50 is formed as a rectangular (or substantially rectangular) resin film having a thermal fusing layer on at least one side thereof, and is disposed such that the thermal fusing layers face each other at locations where the films are thermally fused to each other.

The following describes thermal fusing regions of each of the films 30, 40, 50. Note that in FIG. 3, each of the thermal fusing regions is represented by a dot pattern.

Figure 3:
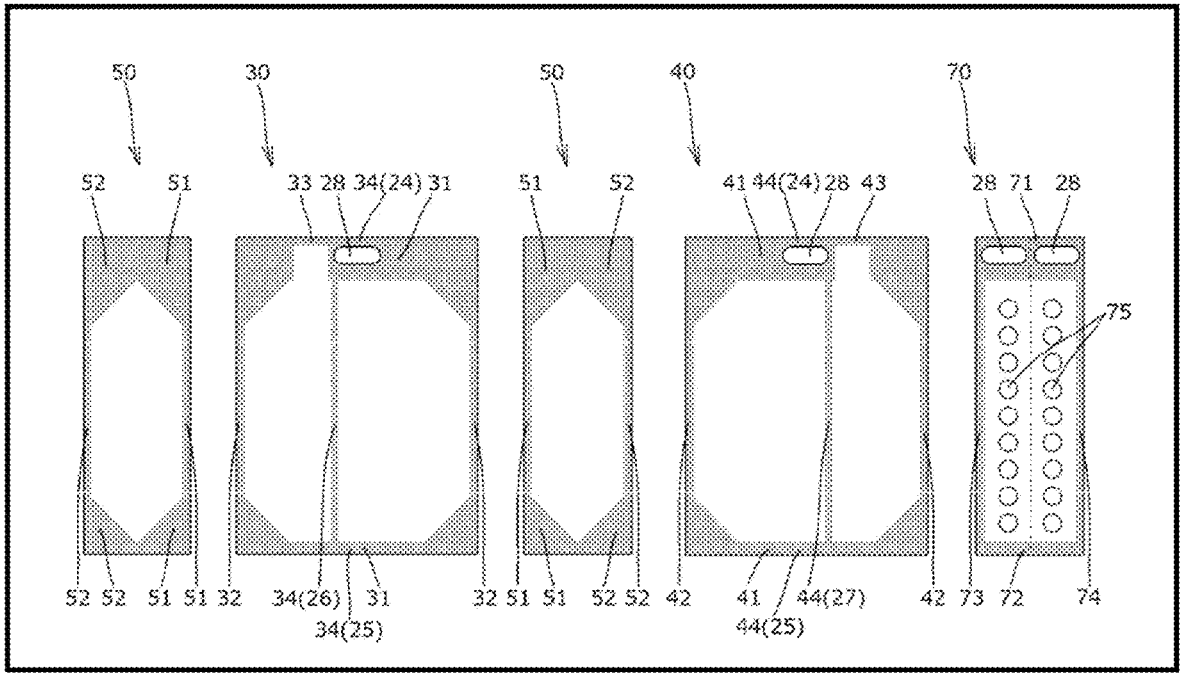
FIG. 3 is an explanatory diagram illustrating each of films constituting the pouch.

First, as illustrated in FIG. 3, the front side film 30 includes a first thermal fusing region 31 to be thermally fused to the rear side film 40, a second thermal fusing region 32 to be thermally fused to the gusset film 50, a third thermal fusing region 33 to be thermally fused to the spout 60, and a fourth thermal fusing region 34 to be thermally fused to the inner supporting member 70.

Further, as illustrated in FIG. 3, the rear side film 40 includes a first thermal fusing region 41 to be thermally fused to the front side film 30, a second thermal fusing region 42 to be thermally fused to the gusset film 50, a third thermal fusing region 43 to be thermally fused to the spout 60, and a fourth thermal fusing region 44 to be thermally fused to the inner supporting member 70.

Further, as illustrated in FIG. 3, the gusset film 50 includes a first thermal fusing region 51 to be thermally fused to the front side film 30 and a second thermal fusing region 52 to be thermally fused to the rear side film 40.

The spout 60 is formed from a synthetic resin or the like and is attached to the pouch main body 20 to function as a dispensing outlet for the contents.

In the present embodiment, as illustrated in FIG. 1, the spout 60 is disposed between the front side film 30 and the rear side film 40 in the sealing portion 23 on the top side of the pouch 10, and is fixed to the front side film 30 (the third thermal fusing region 33) and to the rear side film 40 (the third thermal fusing region 43) by thermal fusing.

As illustrated in FIG. 1, the spout 60 is attached to a position closer to one side (the left side in FIG. 1) than the central portion of the sealing portion 23 on the top side of the pouch 10.

In the present embodiment, when the pouch 10 is being used (when the contents are being dispensed), the pouch 10 is used in a state in which the top portion of the pouch 10 to which the spout 60 is attached is directed horizontally, and at the same time, the side portion of the pouch 10 at which the gusset portion 22 is formed is directed downward. At this time, from the perspective of disposing the spout 60 at a lower position and smoothly dispensing the contents, the pouch 10 is preferably placed on a placement surface with the left side portion of the pouch 10 in FIG. 1 directed downward.

Figure 2:
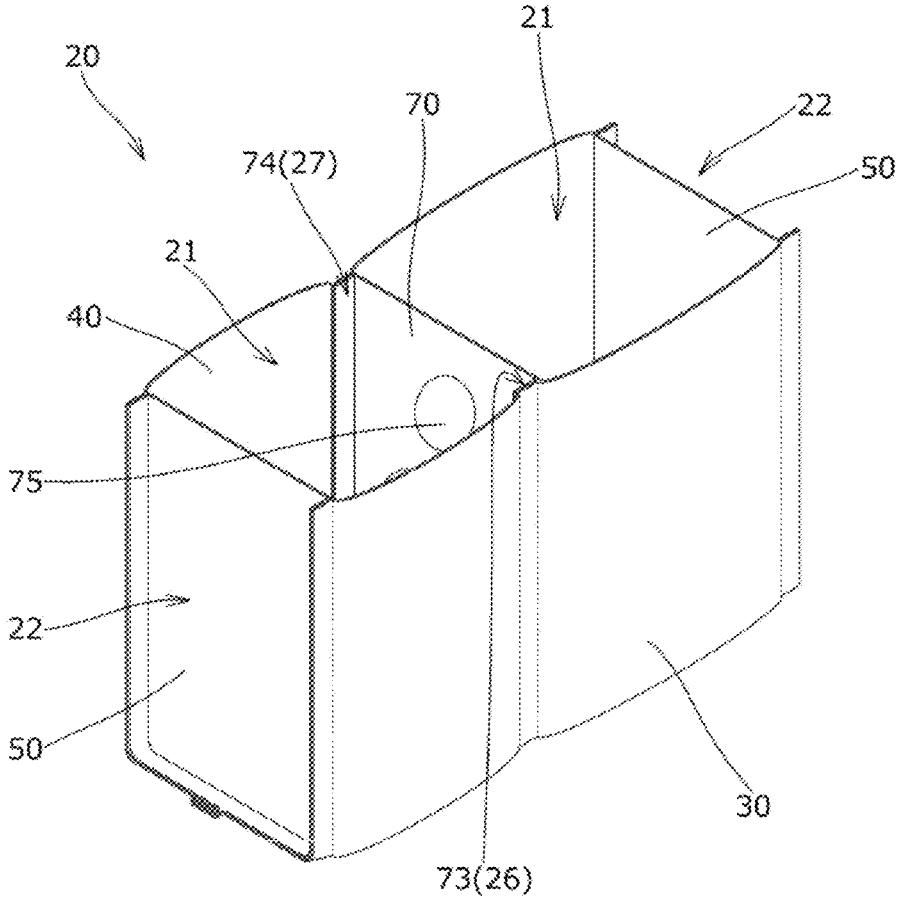
FIG. 2 is a cross-sectional perspective view illustrating the pouch.

As illustrated in FIG. 2, the inner supporting member 70 is disposed inside the pouch main body 20 (the content containing portion 21), and in the present embodiment, the inner supporting member 70 is formed as a rectangular (or substantially rectangular) flexible resin film having a thermal fusing layer on at least one side thereof.

As illustrated in FIG. 3, the inner supporting member 70 includes a first fixing portion 71 on one side in the lengthwise direction thereof, which is fixed to a first fixture portion 24 of the pouch main body 20, and a second fixing portion 72 on the other side in the lengthwise direction thereof, which is fixed to a second fixture portion 25 of the pouch main body 20 facing the first fixture portion 24 across the content containing portion 21.

As illustrated in FIG. 1 and FIG. 3, in the sealing portion 23 on the top side of the pouch 10, the first fixing portion 71 is folded in two such that the thermal fusing layer of the first fixing portion 71 faces the thermal fusing layer of the front side film 30 and the thermal fusing layer of the rear side film 40 and disposed between the front side film 30 and the rear side film 40, and is thermally fused to the front side film 30 and the rear side film 40. In the present embodiment, as illustrated in FIG. 1, a portion of the sealing portion 23 on the top side of the pouch 10 functions as the first fixture portion 24 of the pouch main body 20.

As illustrated in FIG. 1 and FIG. 3, in the sealing portion 23 on the bottom side of the pouch 10, the second fixing portion 72 is folded in two such that the thermal fusing layer of the second fixing portion 72 faces the thermal fusing layer of the front side film 30 and the thermal fusing layer of the rear side film 40 and is disposed between the front side film 30 and the rear side film 40, and is thermally fused to the front side film 30 and the rear side film 40. In the present embodiment, as illustrated in FIG. 1, a portion of the sealing portion 23 on the bottom side of the pouch 10 functions as the second fixture portion 25 of the pouch main body 20.

Note that, in the first fixing portion 71 and the second fixing portion 72, inner side surfaces of the inner supporting member 70 that is folded in two are also thermally fused to each other. For example, in a case where the thermal fusing layer is provided on both surfaces of the inner supporting member 70 or the inner supporting member 70 is a single film having thermal fusing properties, the inner side surfaces of the inner supporting member 70 can be thermally fused to each other.

Further, as illustrated in FIG. 3, the inner supporting member 70 includes a third fixing portion 73 on one side in the widthwise direction thereof, which is fixed to a third fixture portion 26 of the pouch main body 20, and a fourth fixing portion 74 on the other side in the widthwise direction thereof, which is fixed to a fourth fixture portion 27 of the pouch main body 20 facing the third fixture portion 26 across the content containing portion 21.

As illustrated in FIG. 2, the third fixing portion 73 is disposed in a state in which a thermal fusing layer thereof faces the thermal fusing layer on the inner side surface side of the front side film 30, and is thermally fused to the inner side surface of the front side film 30. In the present embodiment, a portion of the inner side surface of the front side film 30 functions as the third fixture portion 26 of the pouch main body 20.

As illustrated in FIG. 2, the fourth fixing portion 74 is disposed in a state in which a thermal fusing layer thereof faces the thermal fusing layer on the inner side surface side of the rear side film 40, and is thermally fused to the inner side surface of the rear side film 40. In the present embodiment, a portion of the inner side surface of the rear side film 40 functions as the fourth fixture portion 27 of the pouch main body 20.

In this way, in the present embodiment, the overall shape of the pouch main body 20 can be maintained by fixing the fixing portions 71, 72, 73, and 74 of the inner supporting member 70 to the fixture portions 24, 25, 26, and 27 of the pouch main body 20, and, in particular, during display, transportation, and the like, even if the pouch main body 20 is placed on the placement surface with the bottom portion of the pouch main body 20 (the side opposite the side to which the spout 60 is attached) directed downward, the bulging in which the front side film 30 and the rear side film 40 separate from each other can be suppressed.

Further, in the present embodiment, the fixing portions 71, 72, 73, and 74 of the inner supporting member 70 are fixed to the pouch main body 20 by the thermal fusing, and thus, when forming at least a part of the sealing portion 23 for forming the pouch main body 20 in a bag-like shape (that is, when forming at least a part of the sealing portion 23 by thermally fusing the front side film 30, the rear side film 40, and the gusset film 50), the inner supporting member 70 can be thermally fused to the pouch main body 20 at the same time.

Figure 4:
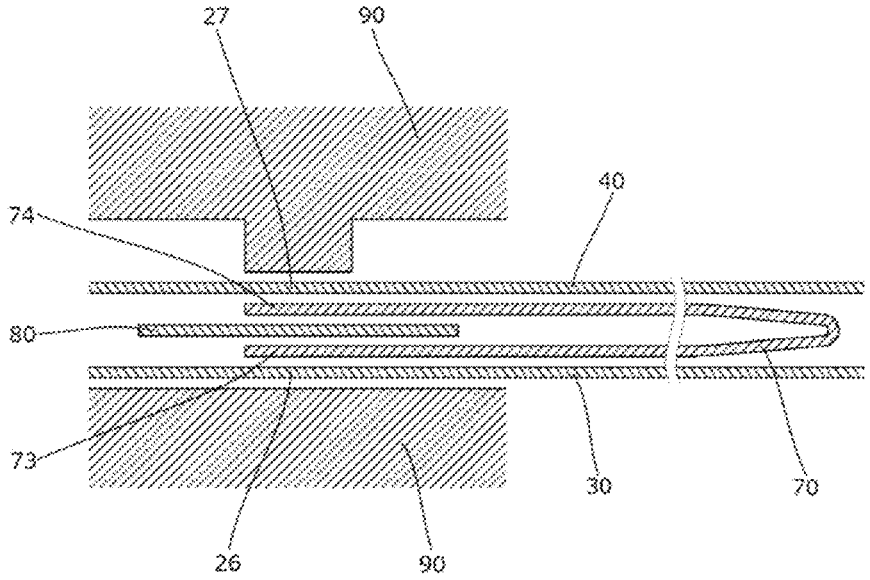
FIG. 4 is an explanatory diagram illustrating an example of a film fusing method.

Note that in the present embodiment, when the inner supporting member 70 is thermally fused to the pouch main body 20, as illustrated in FIG. 4, the inner supporting member 70 is folded in two and disposed between the front side film 30 and the rear side film 40, and the front side film 30, the rear side film 40, and the inner supporting member 70 are clamped between a pair of thermal fusing jigs 90. As a result, a partial region between facing surfaces of the front side film 30 and the inner supporting member 70 (specifically, the fourth thermal fusing region 34, the first fixing portion 71, the second fixing portion 72, and the third fixing portion 73 illustrated in FIG. 3), and a partial region between facing surfaces of the rear side film 40 and the inner supporting member 70 (specifically, the fourth thermal fusing region 34, the first fixing portion 71, the second fixing portion 72, and the fourth fixing portion 74 illustrated in FIG. 3) are thermally fused. Here, when the inner supporting member 70 includes a layer having thermal fusing properties on both surfaces thereof, and it is not desirable for the inner side surfaces obtained by being folded in two to be thermally fused, in this step, to avoid the inner side surfaces (opposing surfaces) of the inner supporting member 70 that is folded in two from being thermally fused to each other, a baffle plate 80 is preferably disposed between the inner side surfaces (the opposing surfaces) of the inner supporting member 70 that is folded in two. When both surfaces of the inner supporting member 70 have the thermal fusing properties, it is possible to use materials having mutually different fusing temperatures on each of the surfaces and to control the fusing temperature such that the inner side surfaces obtained by being folded in two are thermally fused to each other, in contrast, are not thermally fused to each other, but if the baffle plate 80 is used, it is possible to simply prevent the inner side surfaces (the opposing surfaces) of the inner supporting member 70 from becoming thermally fused to each other.

Note that, even when the inner supporting member 70 does not include the layers having the thermal fusing properties on both the surfaces thereof, the baffle plate 80 may be used during the thermal fusing.

Further, a step of thermally fusing the inner supporting member 70 to the front side film 30 and the rear side film 40 described above may be performed simultaneously with the step of forming the sealing portion 23 for forming the pouch main body 20 in a bag-like shape (that is, a step of thermally fusing the front side film 30 to the rear side film 40 and the gusset film 50 to the front side film 30 and the rear side film 40), or may be performed separately.

Further, as illustrated in FIG. 3, the inner supporting member 70 includes a plurality of hole-shaped circulation portions 75, which extend through the inner supporting member 70 in the front-rear direction thereof, for allowing the contents to circulate. Even when the entire outer edge of the inner supporting member 70 is fixed to the inner wall of the content containing portion 21, and the interior of the content containing portion 21 is divided into a plurality of (two) spaces by the inner supporting member 70, as in the present embodiment, the contents can flow inside the content containing portion 21 through the circulation portions 75.

Further, as illustrated in FIG. 2, the inner supporting member 70 is disposed such that an unfused region thereof (a portion located inward of the fixing portions 71 to 74 and formed with the circulation portions 75) is parallel to the gusset films 50.

Further, as illustrated in FIG. 1 and FIG. 3, a handle hole 28 for a user to hold the pouch 10 by passing a hand or fingers is formed in the sealing portion 23 on the top side of the pouch 10. At least a portion (all in the present embodiment) of the handle hole 28 is formed so as to extend through a portion where the front side film 30, the rear side film 40, and the first fixing portion 71 overlap.

Next, the pouch 10 according to a second embodiment of the present invention will be described on the basis of FIG. 12 to FIG. 15. Here, in the second embodiment, excepting a part of the configuration, the configuration is the same as that of the first embodiment described above, and thus, a description will be omitted of the configuration apart from the points of difference.

In the related art, a spout pouch including gusset portions on the left and right of the pouch is known that is a spout pouch including a gripping hole portion (Patent Document 2: JP 2017-210257 A). This type of pouch is contained and transported in a box-like case, such as a cardboard case, during transportation, and the pouch width becomes smaller from the bottom of the spout pouch toward the top. As a result, there is a problem in that, when housing the spout pouches in the box-like case, there are many gaps between the spout pouch and inner walls of the box-like case, resulting in poor storage efficiency. The pouch 10 illustrated in the second embodiment is a pouch intended to solve the present problem.

Figure 12:
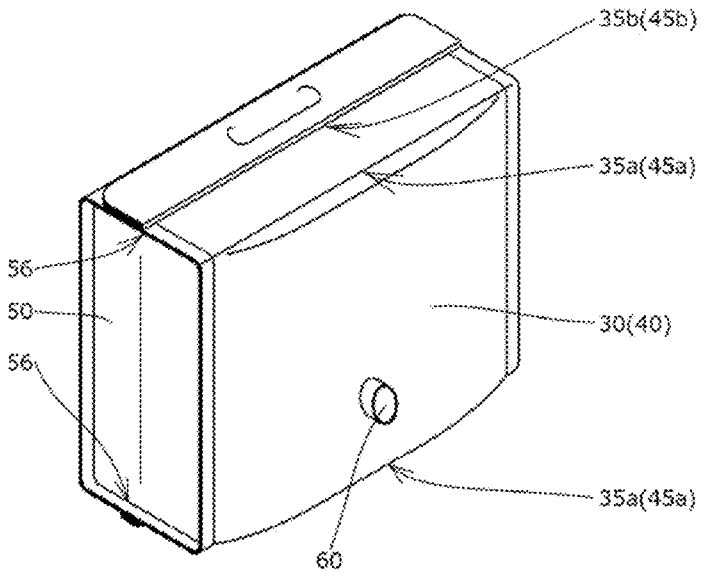
FIG. 12 is an explanatory diagram illustrating a pouch according to a second embodiment.
Figure 13:
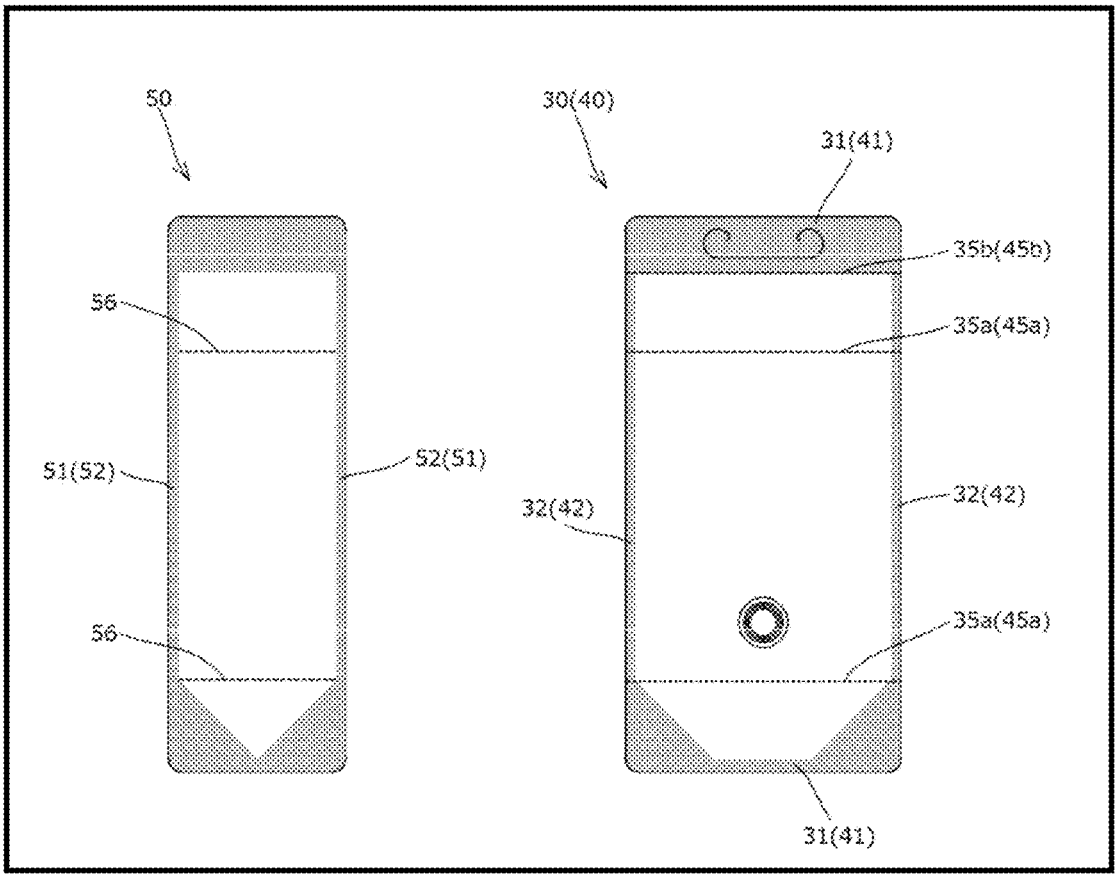
FIG. 13 is an explanatory diagram illustrating each of films according to the second embodiment.

In the second embodiment, for the purpose of adjusting the overall shape of the pouch 10 into a shape suitable for storage, display, or the like (in the present embodiment, the overall shape of the pouch 10 is substantially rectangular), and thus improving the storability and display ability of the pouch 10, as illustrated in FIG. 12 and FIG. 13, creased portions 35, 45, and 56 are formed at predetermined locations of the films 30, 40, and 50.

To describe this more specifically, first, the creased portions 35, 45, and 56 are portions where the films 30, 40, and 50 are processed so as to easily fold at the predetermined locations, by deforming the predetermined locations of the films 30, 40, and 50 into a projection-recess shape in the thickness direction.

As illustrated in FIG. 12 and FIG. 13, the front side film 30 and the rear side film 40 include first creased portions 35*a* and 45*a* and second creased portions 35*b* and 45*b*. The first creased portions 35*a* and 45*a* are each located at two locations on the upper side (the top side of the pouch 10) and the lower side (the bottom side of the pouch 10) and extend in the left-right direction. The second creased portions 35*b* and 45*b* are located further to the upper side than the upper side first creased portions 35*a* and 45*a* (more specifically, at lower end positions of the first thermal fusing regions 31 and 41 at which the front side film 30 and the rear side film 40 are thermally fused to each other) and extend in the left-right direction.

As illustrated in FIG. 12, the first creased portions 35*a* and 45*a* are formed such that the films 30 and 40 fold easily with the outer surface sides thereof forming a projected shape.

Further, one of the second creased portions 35*b* and 45*b* is formed such that the films 30 and 40 fold easily with the outer surface sides thereof forming a projected shape, and the other of the second creased portions 35*b* and 45*b* is formed such that the films 30 and 40 fold easily with the outer surface sides thereof forming a recessed shape.

Further, for a distance in the vertical direction between the first creased portions 35*a* and 45*a* and the second creased portions 35*b* and 45*b* and a distance from the second creased portions 35*b* and 45*b* to the upper ends of the films 30 and 40, the distance from the second creased portions 35*b* and 45*b* to the upper ends of the films 30 and 40 is set to be smaller, and this can prevent, as illustrated in FIG. 12, when a section of the films 30 and 40 above the second creased portions 35*b* and 45*b* is bent over, the section of the films 30 and 40 above the second creased portions 35*b* and 45*b* from jutting out.

Further, as illustrated in FIG. 12 and FIG. 13, the gusset film 50 includes creased portions 56 extending in the left-right direction at two upper and lower locations set at the same heights as the first creased portions 35*a* and 45*a*.

The creased portions 56 are formed such that the gusset film 50 folds easily with the outer surface side of the gusset film forming a projected shape.

As described above, as illustrated in FIG. 12, by forming the creased portions 35, 45, and 56 in the films 30, 40, and 50, the overall shape of the pouch 10 can be made substantially rectangular, which is suitable for storage, and the like. At the same time, the sealing portion 23 on the top side of the pouch 10 (the section above the second creased portion 35*b* or 45*b* of the front side film 30 or the rear side film 40) is easily bent over toward one of the front side film 30 or the rear side film 40.

Figure 14:
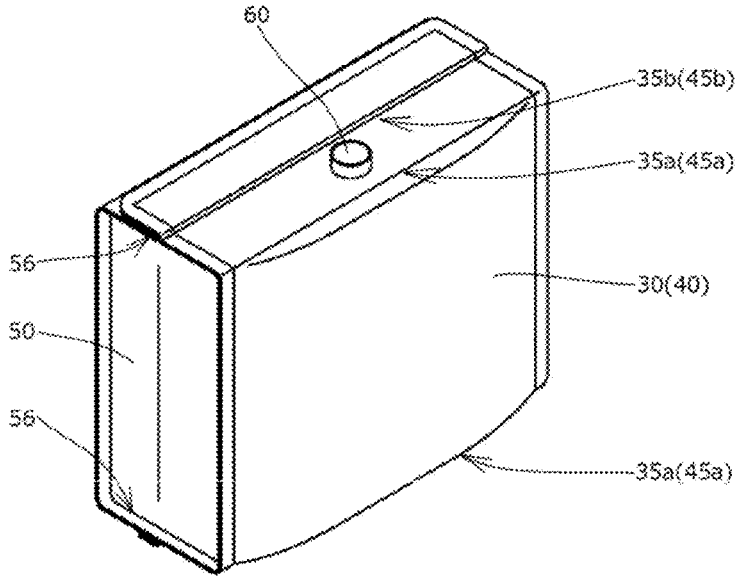
FIG. 14 is an explanatory diagram illustrating a first modified example of the second embodiment.

Note that in the example illustrated in FIG. 12, in a state in which the pouch 10 is placed on the placement surface with the bottom portion of the pouch 10 directed downward, the spout 60 is attached at a position in a side surface of the pouch 10 (more precisely, a position between the upper and lower first creased portions 35*a* and 45*a* of one of the front side film 30 or the rear side film 40), but, as illustrated in FIG. 14, in the state in which the pouch 10 is placed on the placement surface with the bottom portion of the pouch 10 directed downward, it is also conceivable to attach the spout 60 at a position in the top surface of the pouch 10 (more precisely, a position between the upper side first creased portion 35*a* or 45*a* and the second creased portion 35*b* or 45*b* of one of the front side film 30 or the rear side film 40). In the example illustrated in FIG. 14, the storability and the like of the pouch 10 can be further improved.

Figure 15:
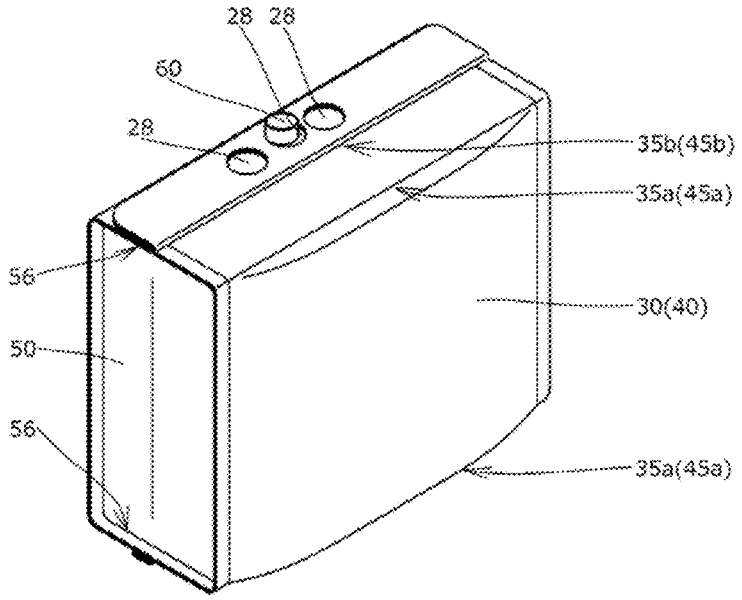
FIG. 15 is an explanatory diagram illustrating a second modified example of the second embodiment.

Further, it is also conceivable that, as in the example illustrated in FIG. 15, the handle hole 28 formed in the sealing portion 23 on the top side of the pouch 10 may be hooked onto the spout 60. In other words, it is conceivable to form the handle hole 28 in a position where the handle hole 28 is hooked onto the spout 60 when the film is bent at the creased portions 35*b* and 45*b*.

To describe this more specifically, in the example illustrated in FIG. 15, first, in the state in which the pouch 10 is placed on the placement surface with the bottom portion of the pouch 10 directed downward, the spout 60 is attached at a position in the top surface of the pouch 10 (more precisely, a position between the upper side first creased portion 35*a* or 45*a* and the second creased portion 35*b* or 45*b* of one of the front side film 30 or the rear side film 40).

Further, the second creased portions 35*b* and 45*b* of the front side film 30 and the rear side film 40 are formed so that the sealing portion 23 on the top side of the pouch 10 is easily bent toward the side at which the spout 60 is installed.

Note that while any method may be used as a specific forming method of the creased portions 35, 45, and 56 described above, an example of a creasing process, as proposed in JP 2018-031838 A by the present applicant, is so-called CS processing in which cold compression molding in a thickness direction is performed on a film overlapping section in which at least one film including a first layer and a second layer having a smaller elongation than that of the first layer is arranged between two films in a non-fixed state, thereby causing the film arranged between the two film portions to protrude toward the second layer at the film overlapping section.

Further, in the second embodiment described above, the description is made in which the creased portions 35, 45, and 56 are formed in the films 30, 40, and 50, but it is sufficient that the creased portions be formed in any of the films. For example, the creased portions 35 and 45 may be formed in the films 30 and 40 only, and when the inner supporting member 70 is provided, a creased portion may also be formed in the inner supporting member 70.

Further, specific modes, such as the positions at which the creased portions 35, 45, and 56 are formed and lengths thereof may be set as desired in accordance with the desired overall shape of the pouch 10.

Further, in the second embodiment described above, the description is made in which the pouch 10 is provided with the inner supporting member 70, but in the configuration of the pouch 10, the inner supporting member 70 itself need not necessarily be provided.

Next, the pouch 10 according to a third embodiment of the present invention will be described on the basis of FIG. 16. Here, in the third embodiment, excepting a part of the configuration, the configuration is the same as that of the first embodiment described above, and thus, a description will be omitted of the configuration apart from the points of difference.

Since the pouch described in Patent Document 1 is formed from a resin film or the like, there is a possibility that an operator or the like may drop the pouch during storage, display, or the like, damaging the pouch. For example, when the contents are large in amount and the weight thereof is heavy, such as with bag-in-box inner bags, there is a burden on the operator carrying the pouch product containing the contents, and it is certainly conceivable that the operator may drop the pouch product during operation. The pouch 10 illustrated in the third embodiment is a pouch intended to leave a record, on the pouch, of an impact on the pouch by the operator or the like.

In the third embodiment, for the purpose of leaving the record on the pouch 10 of the operator or the like dropping the pouch 10 or a strong impact being applied to the pouch 10 during storage, display, or the like, a weakened portion 76 is formed in the inner supporting member 70 itself, or at a fixing portion between the pouch main body 20 and the inner supporting member 70. The weakened portion 76 is weaker than peripheral sections, and breaks or becomes damaged when the pouch 10 is dropped or the like.

As a specific mode of such a weakened portion 76, first, it is conceivable to form the weakened portion 76 in the inner supporting member 70 itself.

Figure 16:
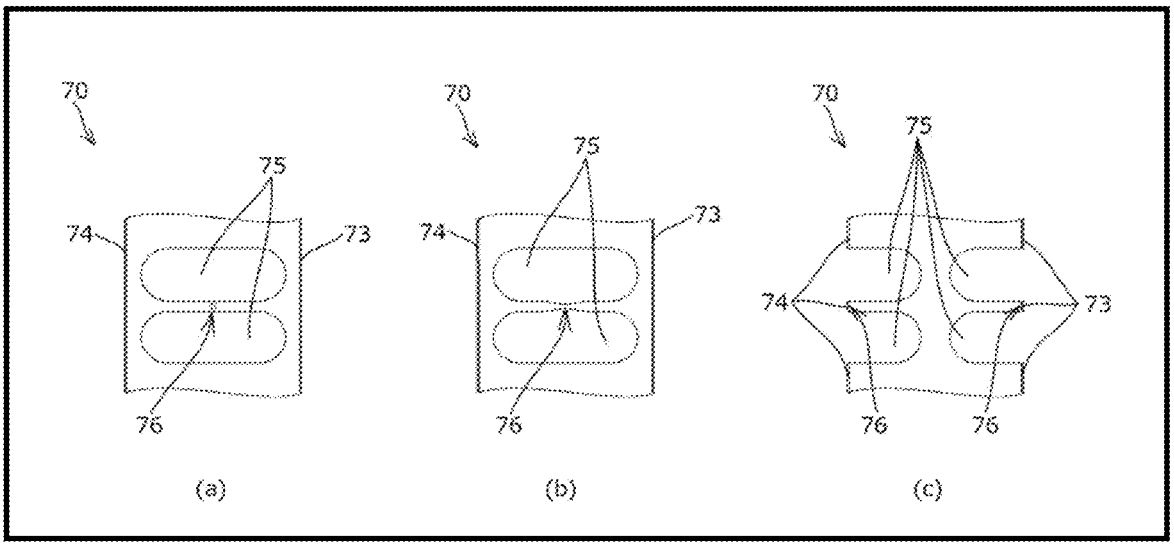
FIG. 16 is an explanatory diagram illustrating an inner supporting member according to a third embodiment.

For the specific mode of the weakened portion 76 in this case, it is conceivable to form a through hole or a slit in a connecting piece between the circulation portions 75 of the inner supporting member 70 to weaken the strength of a portion of the connecting piece, as illustrated in FIG. 16(*a*), or to form a narrowed portion at a portion of the connecting piece to weaken the strength of a portion of the connecting piece, as illustrated in FIG. 16(*b*). When an impact has been applied to the pouch 10, the weakened portion 76 illustrated in FIG. 16(*a*) and FIG. 16(*b*) is completely broken or is stretched without being broken, or alternatively, when the film constituting the inner supporting member 70 is a multi-layer film, breakage or damage such as delamination of the laminate of the front and rear films occurs in the inner supporting member 70. By observing a state of this breakage or damage, it is possible to recognize that the pouch 10 has been subject to the impact, such as being dropped or the like.

Further, for the specific mode of such a weakened portion 76, it is also conceivable to form the weakened portion 76 at a fixing portion between the pouch main body 20 and the inner supporting member 70.

For the specific mode in this case also, the weakened portion 76 may have any configuration as long as it is formed so as to break or be damaged when the pouch 10 is dropped or the like. As illustrated in FIG. 16(*c*), for example, portions having a weaker fixing strength, which are achieved by setting the temperature and pressure during the thermal fusing to be low, by reducing a fixing area, or the like, may be provided at portions of the fixing portion between the pouch main body 20 and the inner supporting member 70 and these portions may be used as the weakened portions 76. When an impact has been applied to the pouch 10, the weakened portions 76 illustrated in FIG. 16(*c*) partially or completely peel off, resulting in breakage of or damage to the inner supporting member 70. By observing a state of this breakage or damage, it is possible to recognize that the pouch 10 has been subject to the impact, such as being dropped or the like.

Further, in the third embodiment, a transparent or semi-transparent portion is provided on at least a portion of the films 30, 40, and 50 constituting the pouch main body 20, such that breakage or damage of the weakened portion 76 when the pouch 10 is dropped or the like, is visible from the outside of the pouch 10.

Further, even when the weakened portion 76 breaks or is damaged when the pouch 10 is dropped or the like, the weakened portion 76 is preferably formed in a mode in which the bulging suppressing function of the pouch 10 by the inner supporting member 70 is not impaired.

In the third embodiment obtained as described above, the weakened portion 76 is formed that breaks or is damaged when the pouch 10 is dropped or the like, and thus a record remains, on the pouch 10, of the dropping or the like of the pouch 10.

Next, the pouch 10 according to a fourth embodiment of the present invention will be described on the basis of FIG. 17 and FIG. 18. Here, in the fourth embodiment, excepting a part of the configuration, the configuration is the same as that of the first embodiment described above, and thus, a description will be omitted of the configuration apart from the points of difference.

Since the pouch described in Patent Document 1 is formed from a resin film or the like, when the pouch product containing the contents is placed as is, it may not be possible for the pouch to maintain self-supporting characteristics due to the flow of the contents. For example, when the contents are large in amount and the weight thereof is heavy, such as with bag-in-box inner bags, it is conceivable that a force imparted to the film during the flow of the contents will increase, which may cause a deterioration in the self-supporting characteristics. The pouch 10 illustrated in the fourth embodiment is a pouch intended to improve the self-supporting characteristics.

Figure 17:
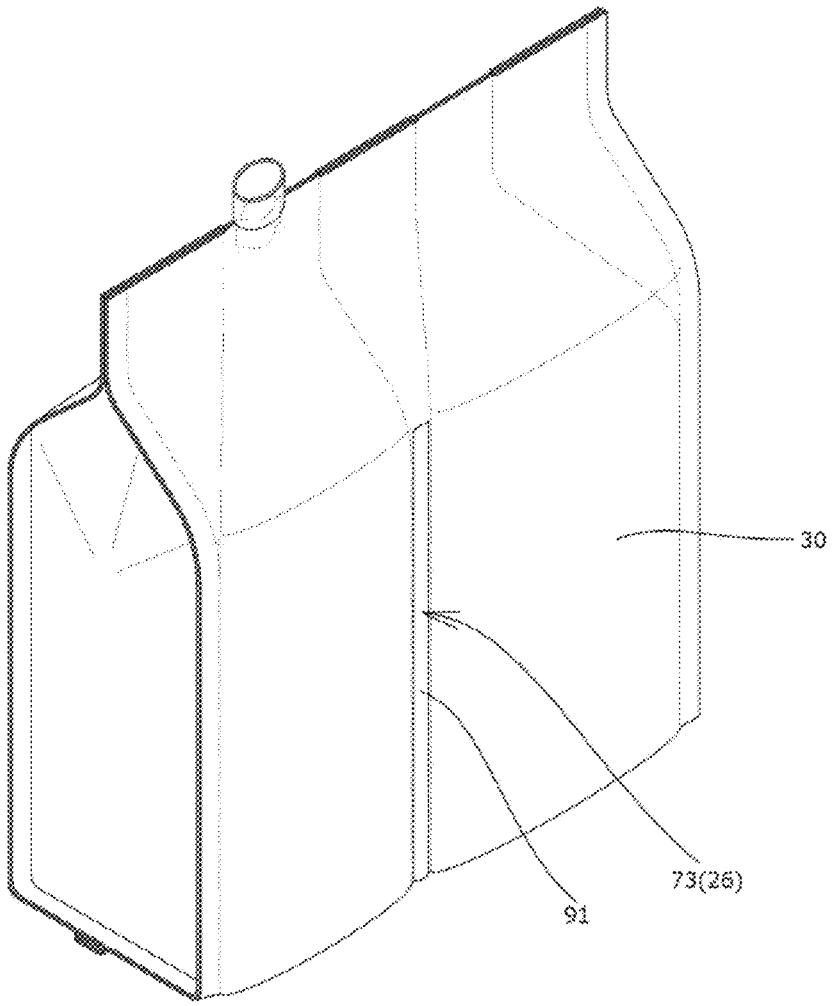
FIG. 17 is an explanatory diagram illustrating a pouch according to a fourth embodiment.
Figure 18:
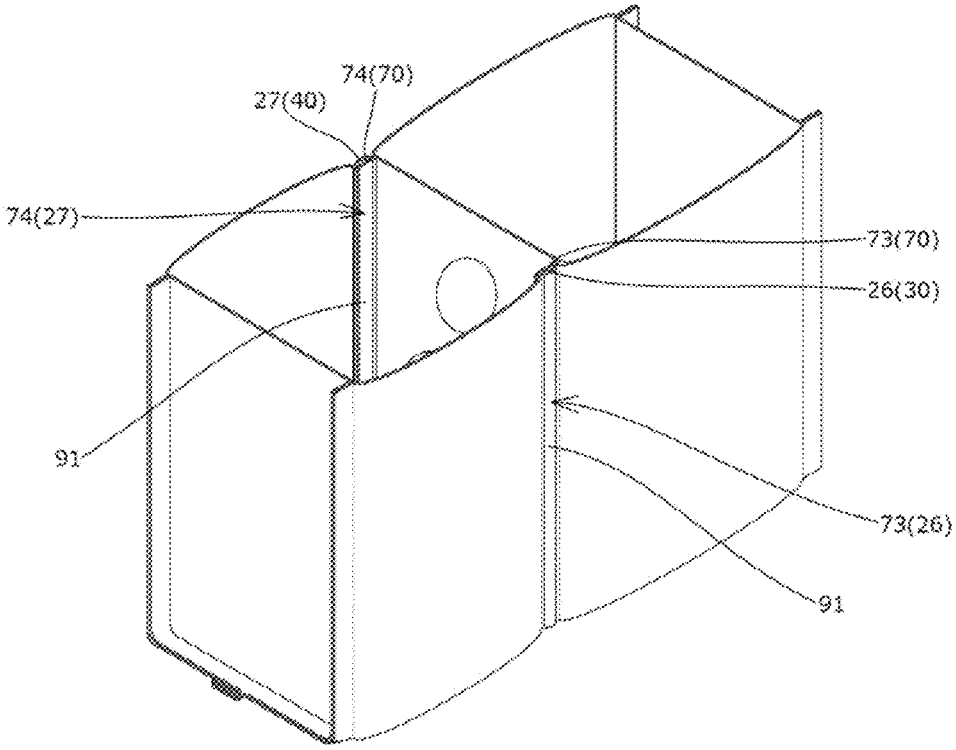
FIG. 18 is an explanatory diagram illustrating the pouch according to the fourth embodiment, and the pouch is cut for illustrative purposes.

In the fourth embodiment, as illustrated in FIG. 17 and FIG. 18, for the purpose of improving the self-supporting characteristics of the pouch 10 when the pouch 10 is placed on the placement surface, a fluid containing portion 91, which contains a fluid such as air in an encapsulated state, is formed in at least one of (both in the present embodiment) the fixing region between the third fixture portion 26 of the pouch main body 20 and the third fixing portion 73 of the inner supporting member 70, and the fixing region between the fourth fixture portion 27 of the pouch main body 20 and the fourth fixing portion 74 of the inner supporting member 70.

To describe this more specifically, as can be seen in FIG. 17 and FIG. 18, the fluid containing portion 91 is formed by forming a non-fixing region at which the fixture portion 26 and the fixing portions 73 and 74 are not fixed to each other in a part of the fixing region between the fixture portion 26 and the fixing portions 73 and 74 and by containing the fluid, such as air, in the encapsulated state in the non-fixing region.

As illustrated in FIG. 17 and FIG. 18, a lower end portion of the fluid containing portion 91 is set at a position in the vicinity of where the front side film 30 and the rear side film 40 bend near the placement surface when the pouch 10 is placed on the placement surface with the bottom portion of the pouch 10 directed downward. Further, an upper end portion of the fluid containing portion 91 is set at a position in the vicinity of where the front side film 30 and the rear side film 40 bend at the top side of the pouch 10.

Note that a specific mode, such as the position of the upper and lower ends of the fluid containing portion 91, may be determined as desired according to the embodiment.

Note that in the fourth embodiment, the fluid containing portion 91 that contains the fluid such as air is provided by forming the non-fixing region at which the fixture portion 26 and the fixing portions 73 and 74 are not fixed to each other in a part of the fixing region of the fixture portion 26 and the fixing portions 73, 74. However, when the front side film 30 and/or the rear side film 40 includes multiple layers, the fluid containing portion 91 may be formed by separating the layers of each of the films 30 and 40 and forming a space at a position that becomes the fluid containing portion 91. Alternatively, when the inner supporting member 70 is formed from a multilayer film, the fluid containing portion 91 may be formed by separating the layers of the film 70 and forming a space at a position that becomes the fluid containing portion 91.

In the fourth embodiment obtained as described above, by forming the fluid containing portion 91, the self-supporting characteristics of the pouch 10 when the pouch 10 is placed on the placement surface can be improved.

Next, the pouch 10 according to a fifth embodiment of the present invention will be described on the basis of FIG. 19 and FIG. 20. Here, in the fifth embodiment, excepting a part of the configuration, the configuration is the same as that of the fifth embodiment described above, and thus, a description will be omitted of the configuration apart from the points of difference.

In the related art, a spout pouch including gusset portions on the left and right of the pouch is filled with the contents through a filling inlet at an upper portion of the pouch (Patent Document 3: JP H11-314644 A). In the pouch described in Patent Document 3, foaming may occur in the contents in the pouch even when the pouch is filled with the contents. In this case, since a foam part rises up as the filling progresses, to seal and close the filling inlet of the pouch, it is necessary to contain the foam part inside the pouch when the pouch is filled with all the contents. In other words, since, taking into account the foam part, a surplus space needs to be provided inside the pouch, the pouch is filled with a lower volume of the contents with respect to the size of the pouch, thus resulting in a possibility of causing poor filling efficiency. The pouch 10 illustrated in the fifth embodiment is a pouch intended to improve the filling efficiency.

Figure 19:
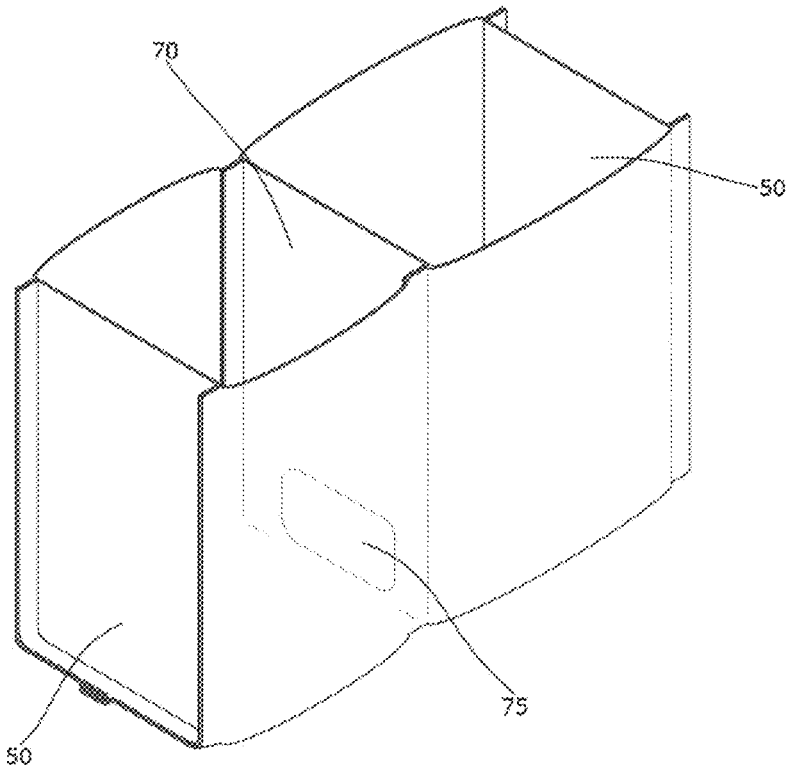
FIG. 19 is an explanatory diagram illustrating a pouch according to a fifth embodiment, and the pouch is cut for illustrative purposes.
Figure 20:
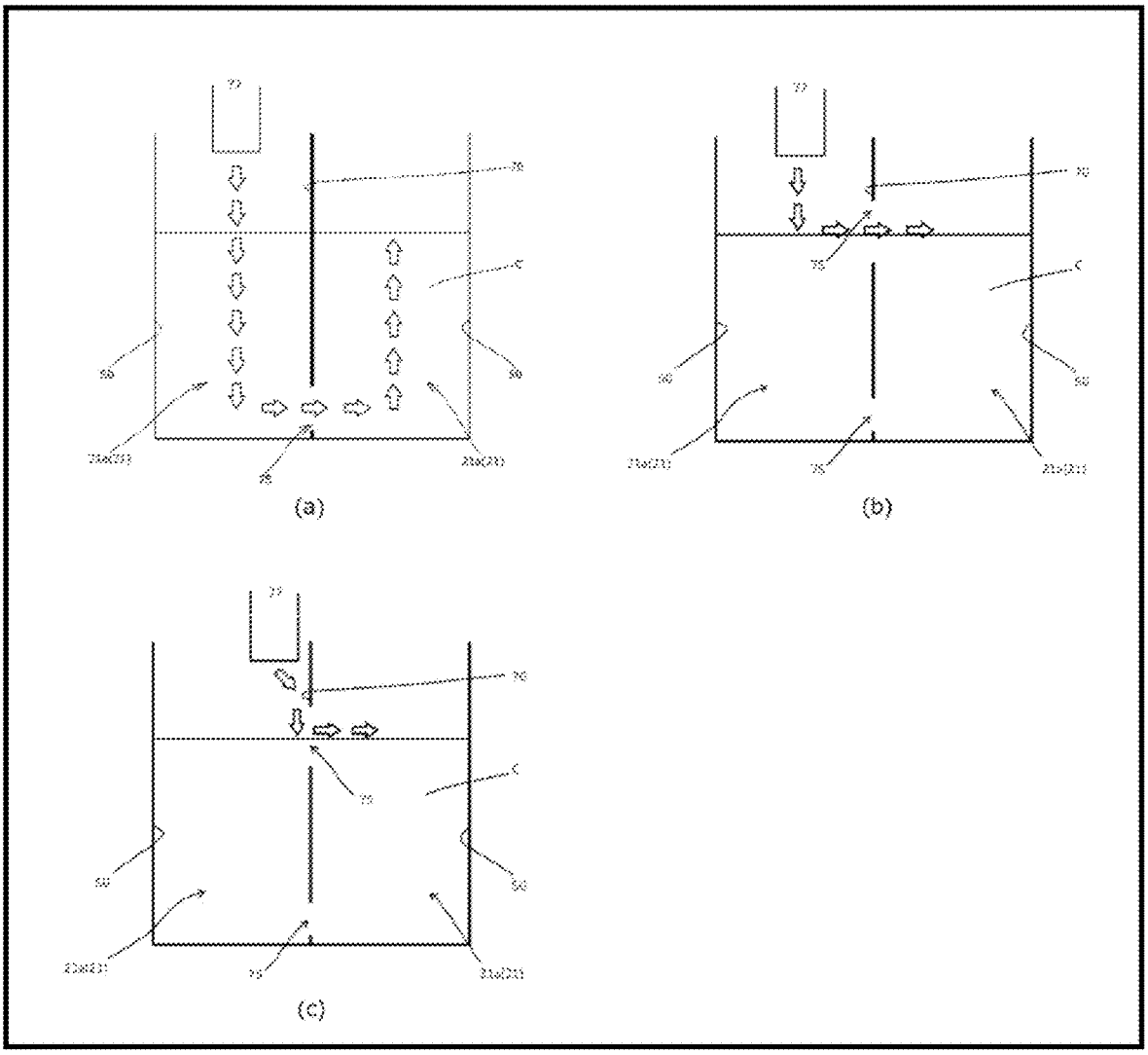
FIG. 20 is an explanatory diagram illustrating a state at a time when the pouch is filled with contents according to the fifth embodiment.

In the fifth embodiment, as illustrated in FIG. 19 and FIG. 20, the circulation portion 75 is formed only in a lower region of the inner supporting member 70 for the purpose of suppressing the foaming that tends to occur inside the pouch 10 when the pouch 10 is filled with contents such as liquid detergent.

To describe this more specifically, in the fifth embodiment, as illustrated in FIG. 19 and FIG. 20, the circulation portion 75 is formed only in the lower region of the inner supporting member 70 (the region of the lower half of the inner supporting member 70 in the vertical direction), and the circulation portion 75 is not formed in the upper region of the inner supporting member 70 (the region of the upper half of the inner supporting member 70 in the vertical direction).

Then, in the fifth embodiment, when the pouch 10 is filled with the contents, as illustrated in FIG. 20, one of the spaces 21*a* inside the content containing portion 21 that are partitioned by the inner supporting member 70 is filled with the contents from the top side of the pouch 10 where the sealing portion 23 is not formed (the films 30, 40, and 70 are not thermally fused) through the filling nozzle 77. The contents supplied to one of the spaces 21*a* inside the content containing portion 21 are supplied to the other space 21*a* inside the content containing portion 21 via the circulation portion 75. Note that a nozzle opening of the filling nozzle 77 is initially disposed near the bottom of the pouch 10, and the filling nozzle 77 moves upward along with the liquid surface of the contents such that the opening does not touch the liquid surface while the space 21 is filled with the contents.

In the fifth embodiment obtained as described above, as illustrated in FIG. 19 and FIG. 20, since the circulation portion 75 for allowing the plurality of spaces 21*a* to communicate with each other is formed only in the lower region of the inner supporting member 70 (the region of the lower half of the inner supporting member 70 in the vertical direction), when the pouch is filled with the contents, a flow of the contents can be rectified, as illustrated in FIG. 20. Thus, foaming when filling can be suppressed even when the pouch is filled with the contents that causes the foaming, such as liquid detergent or the like. Further, as a result, it is possible to reduce the surplus space in the content containing portion 21 that is set in advance taking into account the foaming of the contents when filling, and the filling efficiency can thus be improved.

In the fifth embodiment, the circulation portion 75 is provided in the lower side of the inner supporting member 70, but the position of the circulation portion 75 is not limited to the lower side, and, as illustrated in FIG. 20(*b*), the circulation portion 75 may also be provided on the upper side, and the foam may be periodically allowed to escape from the content containing portion 21 on the filling side to the adjacent content containing portion 21. Further, as illustrated in FIG. 20(*c*), the filling nozzle 77 may be disposed close to the inner supporting member 70, and, by pouring the contents toward the inner supporting member 70, the pouch may be filled with contents while the contents are caused to flow along the inner supporting member 70. Further, by disposing a member having fine through holes, such as a mesh, in the circulation portion 75, the foam can be broken up and reduced when the contents flow through the circulation portion 75.

Next, the pouch 10 according to a sixth embodiment of the present invention will be described on the basis of FIG. 21. Here, in the sixth embodiment, excepting a part of the configuration, the configuration is the same as that of the first embodiment described above, and thus, a description will be omitted of the configuration apart from the points of difference.

The pouch described in Patent Document 2 includes gripping holes for gripping the pouch with a hand or fingers. In the pouch described in Patent Document 2, a slit extending through the film is formed in the film and used as the gripping hole. In this case, when the user passes their hand or fingers through the gripping hole in the pouch product containing the contents and lifts the pouch, a load caused by the weight of the contents themselves acts on end portions of the slit, and the end portions of the slit may trigger tearing of the slit. In particular, it is conceivable that the greater the weight of the contents, the greater the possibility thereof.

Figure 21:
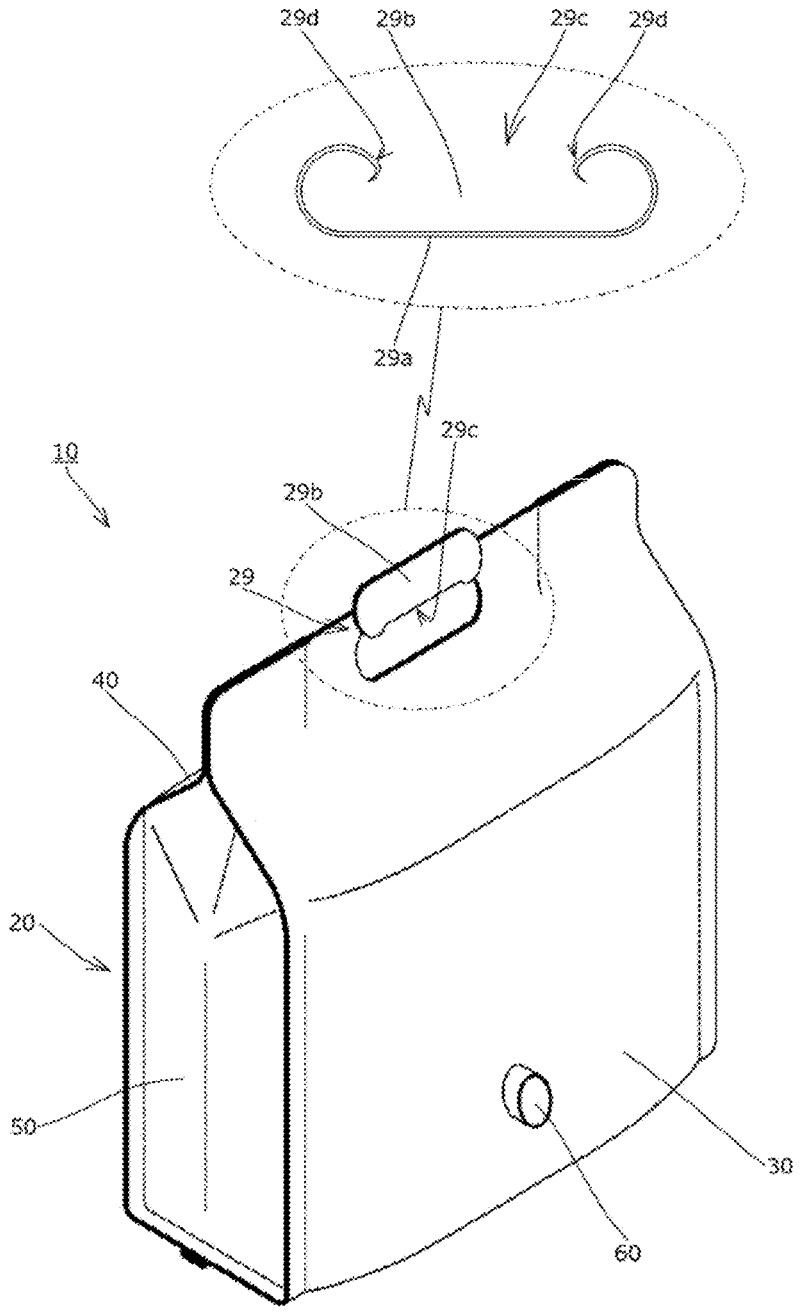
FIG. 21 is an explanatory diagram illustrating a pouch according to a sixth embodiment.

In the sixth embodiment, as illustrated in FIG. 21, in a region of the sealing portion 23 on the top side of the pouch 10 where the films 30, 40, and 70 are thermally fused, a handle portion 29 is formed through which the user passes their hand or fingers for lifting the pouch 10.

The handle portion 29 is configured by forming a penetration slit 29*a* extending through the films 30, 40, and 70 in the front-rear direction so that the fingers of the user can be passed through a hole defined by the penetration slit 29*a*.

The penetration slit 29*a* is formed as a slit with width, having the width in a direction orthogonal to the extending direction thereof.

In each of the films 30, 40, and 70, handle tabs 29*b* are formed that are divided from a peripheral section thereof by the penetration slit 29*a* (in other words, that are positioned on an inner side of the penetration slit 29*a* in a pouch surface direction).

A portion of the outer edge of each of the handle tabs 29*b* is connected to the peripheral section by a folding connection portion 29*c*.

The folding connection portion 29*c* is formed at a portion of the outer edge of the handle tab 29*b* located on the outer side of the pouch (in the case of the present embodiment, the upper side). In this way, when lifting the pouch 10 using the handle portion 29, since the fingers of the user come into contact with each of the films 30 and 40 that are folded in the vicinity of the folding connection portion 29*c*, it is possible to avoid causing pain in the fingers of the user.

As illustrated in FIG. 21, when viewed in a plan view in the front-rear direction, the penetration slit 29*a* has an overall shape in which a portion of an annular shape is cut out.

Further, both end portions 29*d* of the penetration slit 29*a* are formed in a curved manner so as to extend toward the inner side (the lower side in the present embodiment) of the handle tab 29*b*. As a result, when each of the films 30, 40, 70 is folded over in the vicinity of the folding connection portion 29*c* and the pouch 10 is lifted, stress is unlikely to be applied to the tips of both the end portions 29*d* of the penetration slit 29*a*, and it is thus possible to suppress the occurrence of the tearing of the films triggered by both the end portions 29*d* of the penetration slit 29*a*.

Note that in the sixth embodiment described above, the handle portion 29 is formed at a position where the films 30, 40, and 70 overlap, but the formation position of the handle portion 29 may be any position, that is, the handle portion 29 may be formed at a position where only the films 30 and 40 overlap, for example.

Further, in the sixth embodiment described above, the description is made in which the pouch 10 is provided with the inner supporting member 70, but in the configuration of the pouch 10, the inner supporting member 70 itself need not necessarily be provided.

Next, the pouch 10 according to a seventh embodiment of the present invention will be described on the basis of FIG. 22. Here, in the seventh embodiment, excepting a part of the configuration, the configuration is the same as that of the first embodiment described above, and thus, a description will be omitted of the configuration apart from the points of difference.

In the pouch described in Patent Document 3, the spout is provided at a top corner of the pouch. It goes without saying that with respect to the pouch described in Patent Document 3, a single type of content is contained in the pouch, and the pouch is displayed in a store, such as a retail outlet or the like, as the pouch product. When the volume of the contents is increased, the user can use the product for a long period of time with one purchase, without making a purchase a plurality of times. However, for example, it is also conceivable that, in the case of a pouch product, such as a liquid detergent, shampoo, or the like, in which the scent or the color also exert an influence on a preference of the user, in the course of the user using the contents, the user may wish to change the scent or the color. The pouch 10 illustrated in the seventh embodiment is a pouch intended to respond to such a wish by the user.

Figure 22:
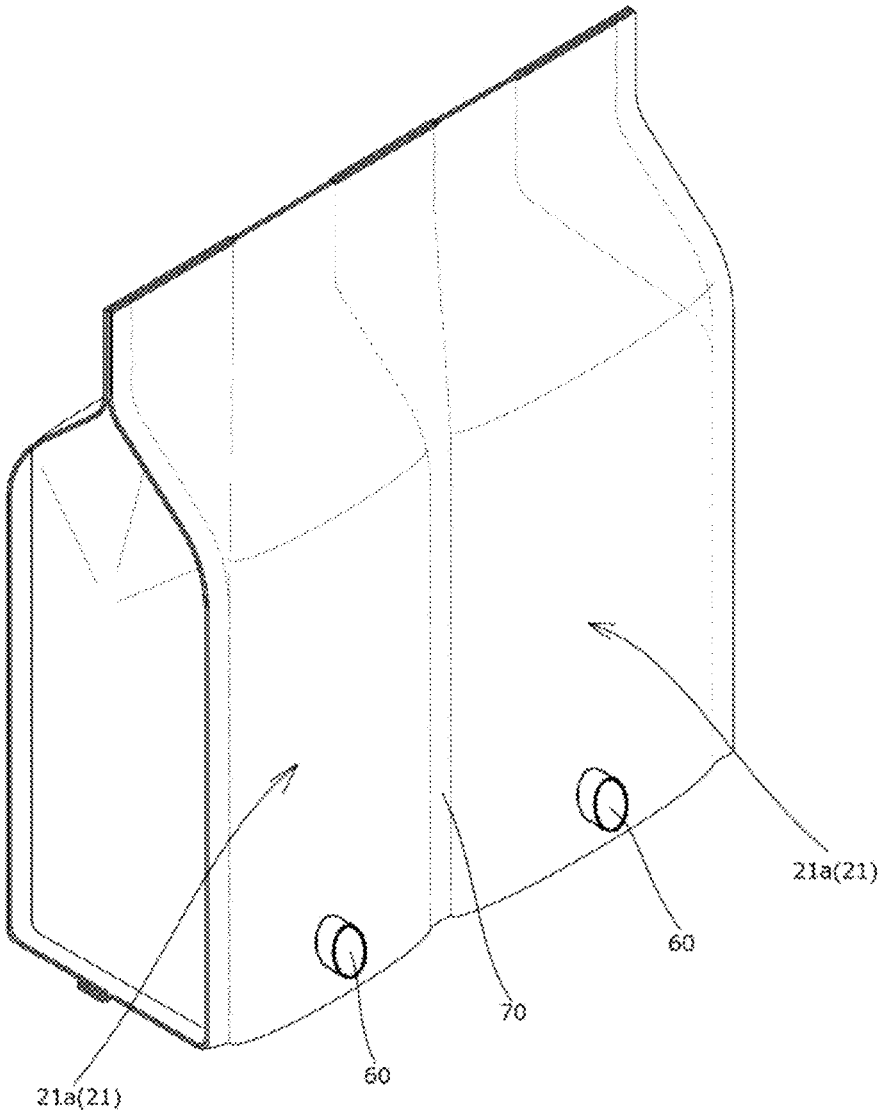
FIG. 22 is an explanatory diagram illustrating a pouch according to a seventh embodiment.

First, in the first embodiment described above, the description is made in which the circulation portion 75 is formed in the inner supporting member 70, but in the seventh embodiment, as illustrated in FIG. 22, the circulation portion 75 is not formed in the inner supporting member 70, and the inner supporting member 70 is installed so as to completely separate the interior of the content containing portion 21 into a plurality (two in the present embodiment) of the spaces 21*a*. In other words, the contents do not flow between the plurality (two) of the spaces 21*a* partitioned by the inner supporting member 70.

Further, in the seventh embodiment, as illustrated in FIG. 22, the spout 60 is attached for each of the plurality of spaces 21*a* inside the content containing portion 21.

In the seventh embodiment obtained as described above, the contents are respectively contained in each of the spaces 21*a* inside the content containing portion 21, and, at the same time, the contents contained in each of the spaces 21*a* can be individually dispensed using the spout 60. As a result, for example, different contents can be contained in each of the spaces 21*a*, and the contents can be selected and dispensed in accordance with the wishes of the user, or two or more types of contents can be dispensed and blended to change the color and fragrance of the contents. Alternatively, the two types of contents can be used in an alternating manner and the user can use the contents without being bored by the one type of content.

Note that in the seventh embodiment described above, the description is made in which the interior of the content containing portion 21 is completely separated into the two spaces 21*a* by the one inner supporting member 70, but the interior of the content containing portion 21 may be completely separated into three or more of the spaces 21*a* by the two or more inner supporting members 70, and in this case, the number of the spouts 60 may be determined as desired in accordance with the number of the spaces 21*a*.

Next, the pouch 10 according to an eighth embodiment of the present invention will be described based on FIG. 23 to FIG. 25. Here, in the eighth embodiment, excepting a part of the configuration, the configuration is the same as that of the first embodiment described above, and thus, a description will be omitted of the configuration apart from the points of difference.

In the related art, there is a pouch in which a spout is provided at a lower portion of the pouch and the contents are dispensed from the spout (Patent Document 4: JP 3194684 UM-B). However, in a case of the pouch described in Patent Document 4 in which there is a distance between the spout and the bottom surface of the pouch, when the contents are depleted, the contents remain in a gap portion between the spout and the pouch bottom surface. Thus, when attempting to fully dispense the contents, it is necessary to pick up the pouch and tilt the pouch diagonally such that the contents moves toward the spout, and thus dispense the contents. The pouch 10 illustrated in the eighth embodiment is a pouch intended to reduce a remaining amount of the contents when dispensing the contents.

Figure 23:
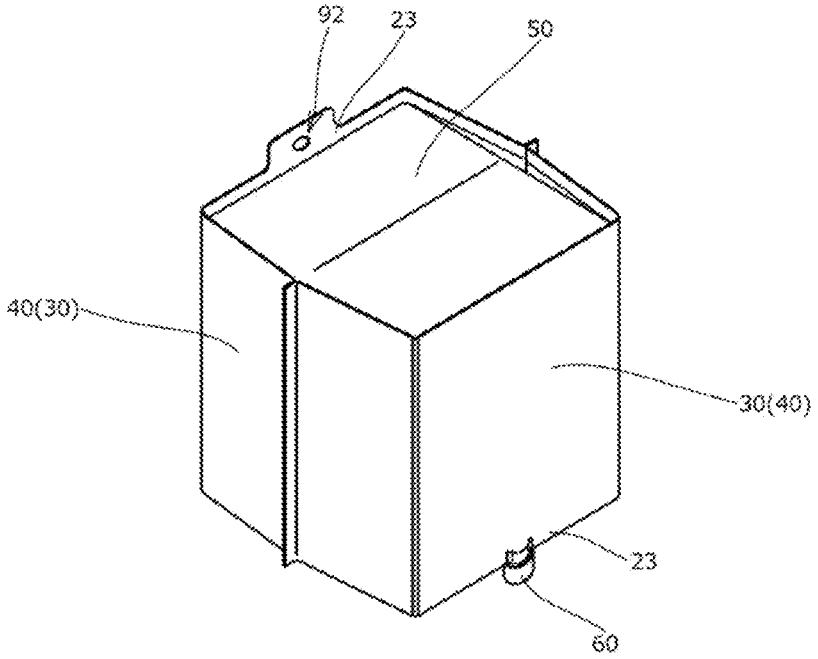
FIG. 23 is an explanatory diagram illustrating a pouch according to an eighth embodiment.
Figure 24:
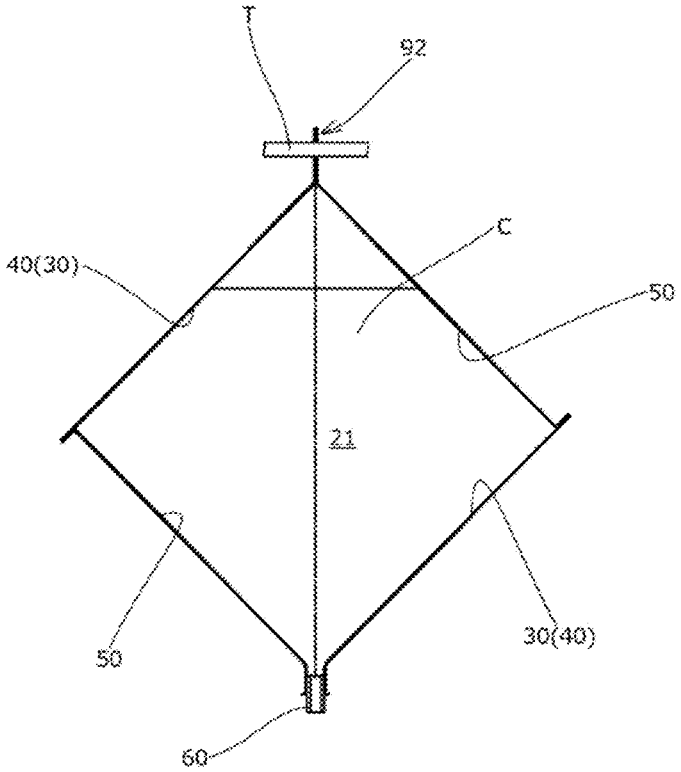
FIG. 24 is an explanatory diagram illustrating a state in which the pouch according to the eighth embodiment is suspended.

In the eighth embodiment, as illustrated in FIG. 23, a hanging portion 92 is formed for hanging and using the pouch 10. Further, the spout 60 is attached at a position that is a lower side of the pouch 10 in a case in which the pouch 10 is suspended using the hanging portion 92, and this allows a reduction in the amount of contents (fluid contents) C remaining in the content containing portion 21 to be measured.

To describe this more specifically, in the eighth embodiment, as illustrated in FIG. 23, the hanging portion 92 is formed that is configured as a hole extending through the sealing portion 23, in the sealing portion 23 (in the vicinity of the center in the lengthwise direction) at which one of the front side film 30 or the rear side film 40 and one of the pair of the gusset films 50 are thermally fused.

Further, as illustrated in FIG. 23, the spout 60 is attached at a diagonal position from the position at which the hanging portion 92 is formed, and specifically, is attached to the seal 23 (in the vicinity of the center in the lengthwise direction) at which the other one of the front side film 30 or the rear side film 40 and the other of the pair of gusset films 50 are thermally fused.

Figure 25:
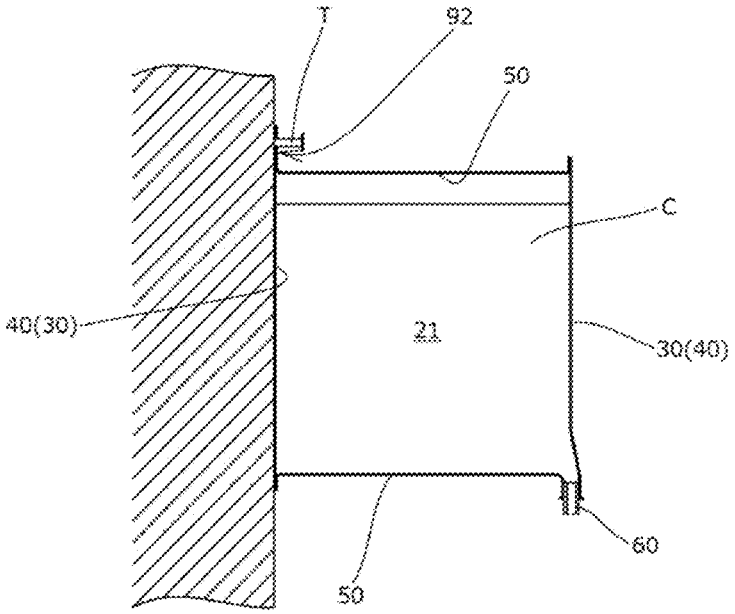
FIG. 25 is an explanatory diagram illustrating a state in which the pouch according to the eighth embodiment is suspended in a different mode from FIG. 24.

In the eighth embodiment, since the hanging portion 92 and the spout 60 are provided as described above, as illustrated in FIG. 24, when a hanging implement T, such as a bolt, is inserted into the hanging portion 92 and the pouch 10 is suspended, or, as illustrated in FIG. 25, when the hanging implement T, such as a bolt, is inserted into the hanging portion 92, and the pouch 10 is suspended such that a back side of one of the front side film 30 or the rear side film 40 is supported by a vertical wall, the spout 60 is positioned on the lower side of the pouch 10 (the content containing portion 21), and this can reduce the amount of contents (fluid contents) C remaining in the content containing portion 21 without manually tilting the pouch 10.

Note that in the eighth embodiment described above, the description is made in which the hanging portion 92 is formed in the hole shape through which the hanging implement T such as the bolt or the like, illustrated in FIG. 23 and the like, is inserted, but the hanging portion 92 may be configured in any manner as long as the pouch 10 can be suspended therewith, and the hanging portion 92 may be a hook-shaped component, for example, that is fixed (adhered or fused) to the pouch 10.

Further, in the eighth embodiment described above, the description is made on the installation positions of the hanging portion 92 and the spout 60 as described above, but the installation positions of the hanging portion 92 and the spout 60 may be any position as long as the spout 60 is positioned on the lower side of the pouch 10 in the state in which pouch 10 is suspended using the hanging portion 92.

Further, in the eighth embodiment described above, the description is made in which the pouch 10 is provided with the inner supporting member 70, but in the configuration of the pouch 10, the inner supporting member 70 itself need not necessarily be provided.

The embodiments of the present invention have been described in detail above, but the present invention is not limited to the embodiments described above, and various design modifications can be made insofar as they do not depart from the scope of the claims of the present invention. Further, the pouch 10 may be configured by any combination of configurations of the above-described plurality of embodiments and modified examples to be described below.

For example, in the embodiments described above, the description is made in which the pouch 10 is housed in the outer case (not illustrated) and utilized during the use, display, or transportation thereof, but the pouch 10 itself may be used, or may be displayed or transported, without being housed in the outer case (not illustrated).

Further, with respect to specific modes of each of the films 30 to 50 constituting the pouch main body 20, as long as each film includes a layer having thermal fusing properties, such as an olefin-based layer made of low density polyethylene or polypropylene or a polyester-based layer made of polyethylene terephthalate (PET), or the like on at least one of the surfaces thereof, a film including a single film of the thermal fusing layer may be used, or any desired layer may be layered to the thermal fusing layer. Any material may be used as a material constituting the multilayer, and the multilayer may be formed as desired by layering a known polyester such as PET or polybutylene terephthalate (PBT), polypropylene, polyamide, polyethylene, aluminum foil, or the like.

Further, in the embodiments described above, the description is made in which the pouch main body 20 is formed from the four resin films, namely, the front side film 30, the rear side film 40, and the pair of gusset films 50. However, a specific mode of the pouch main body 20, such as the number of resin films and the like constituting the pouch main body 20, is not limited to the above-described example, and the pouch main body 20 may be formed in any manner, such as one resin film (that is, a resin film in which the front side film 30, the rear side film 40, and the gusset film 50 are integrally formed) is wound in a tubular shape and thermally fused at predetermined locations, for example.

Further, in the embodiments described above, the description is made in which the pouch main body 20 is formed as the so-called side-gusseted pouch in which the gusset portions 22 are formed on both sides thereof. However, a specific mode of the pouch main body 20 may be any mode, and may be, for example, a so-called bottom gusset pouch having the one gusset portion 22, a pouch including a total of three of the gusset portions 22 on both side portions and the bottom portion thereof, and the like.

Figure 5:
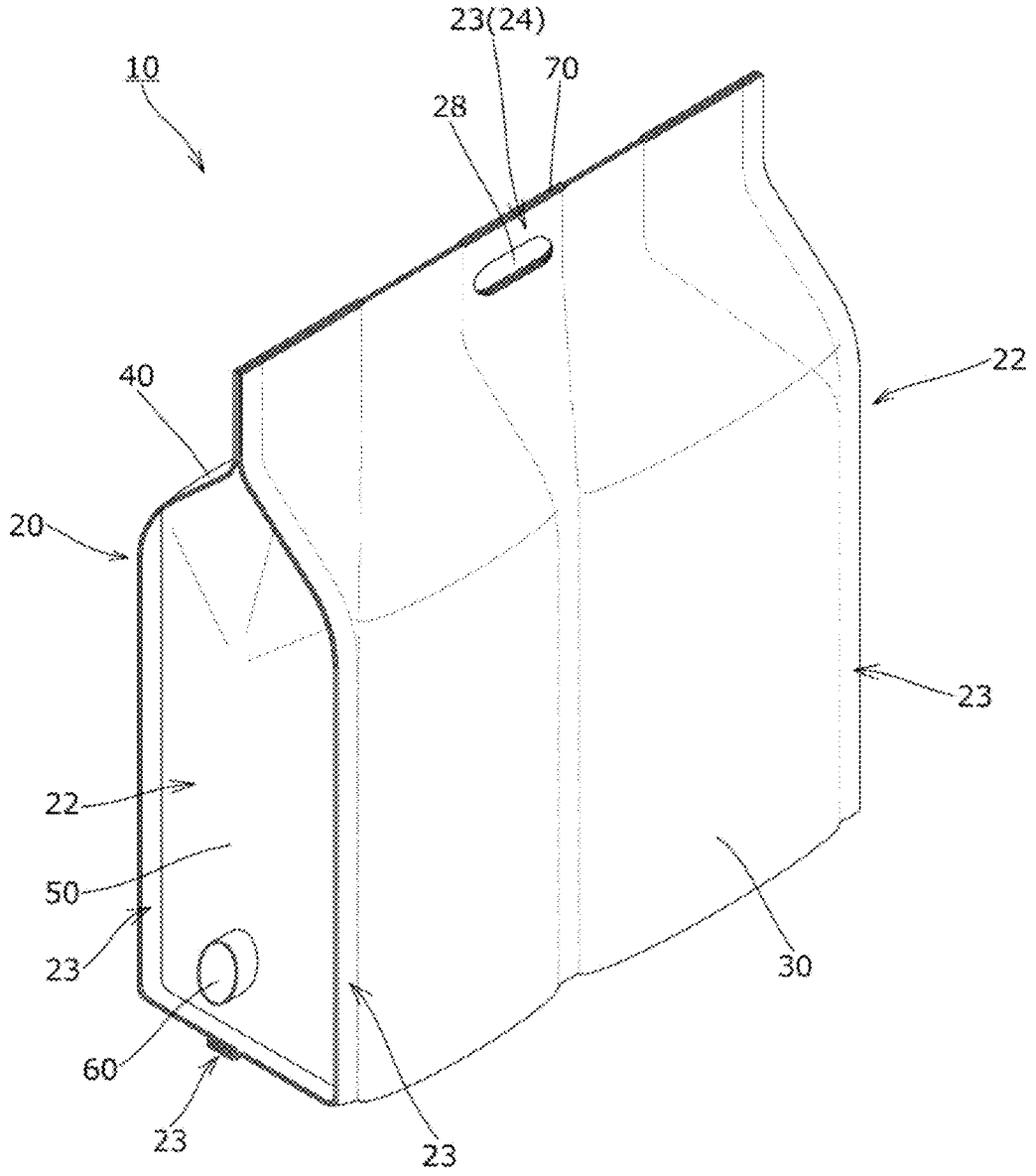
FIG. 5 is a perspective view illustrating a modified example of a spout attaching position.
Figure 6:
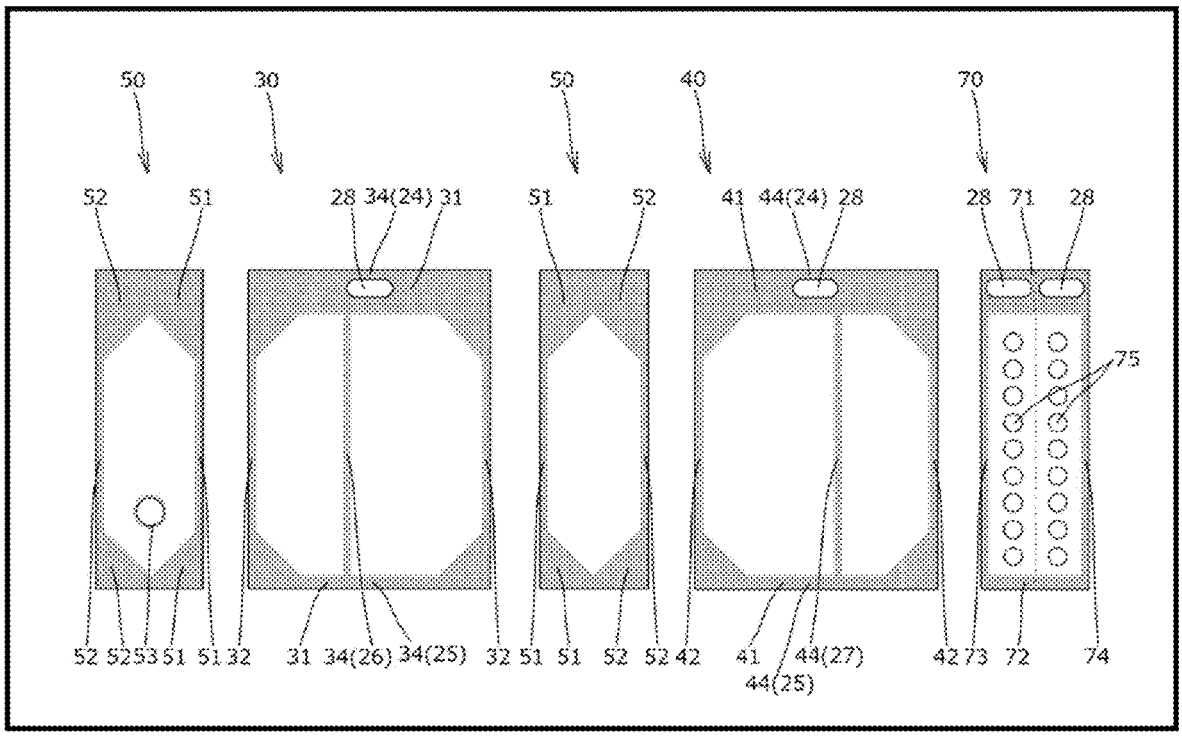
FIG. 6 is an explanatory diagram illustrating each of the films in the example illustrated in FIG. 5.

Further, in the embodiments described above, the description is made in which the spout 60 is attached to the sealing portion 23 on the top side of the pouch 10, but a specific arrangement of the spout 60 is not limited to the above description. For example, as illustrated in FIG. 5 and FIG. 6, the spout 60 may be attached to the gusset portion 22 (the gusset film 50) by a method such as thermal fusing. Note that in the example illustrated in FIG. 5 and FIG. 6, the third thermal fusing region 53 to which the spout 60 is thermally fused is formed in one of the gusset films 50. In FIG. 6, the thermal fusing regions at which the films 30 to 50 are thermally fused are represented by the dot pattern. Further, in a similar manner, as illustrated in FIG. 12 and FIG. 21, the spout 60 may be attached to the front side film 30 or the rear side film 40. Further, the pouch 10 may also be configured without providing the spout 60 itself, such that a dispensing outlet is formed by cutting out a portion of the pouch main body 20.

Further, in the embodiments described above, the description is made in which the inner supporting member 70 is configured as a resin film, but a specific mode of the inner supporting member 70 may be any mode, as long as the inner supporting member 70 includes the first fixing portion 71 and the second fixing portion 72 illustrated in FIG. 3 and FIG. 6, and the inner supporting member 70 may be formed in a string-like shape or a band-like shape, for example. The inner supporting member 70 is preferably formed from a material having flexibility (elasticity).

Further, when the inner supporting member 70 is constituted by the resin film, the inner supporting member 70 may be formed from a resin film having a different structure than that of each of the films 30, 40, and 50 that constitutes the pouch main body 20. However, from the perspective of reducing the manufacturing costs of the pouch 10 also, the inner supporting member 70 is preferably formed from the resin film having the same structure as that of each of the films 30, 40, and 50 that constitutes the pouch main body 20.

Further, the method of fixing the inner supporting member 70 with respect to the pouch main body 20 is not limited to the thermal fusing described above, and may be any method, such as bonding using an adhesive, or the like.

Figure 7:
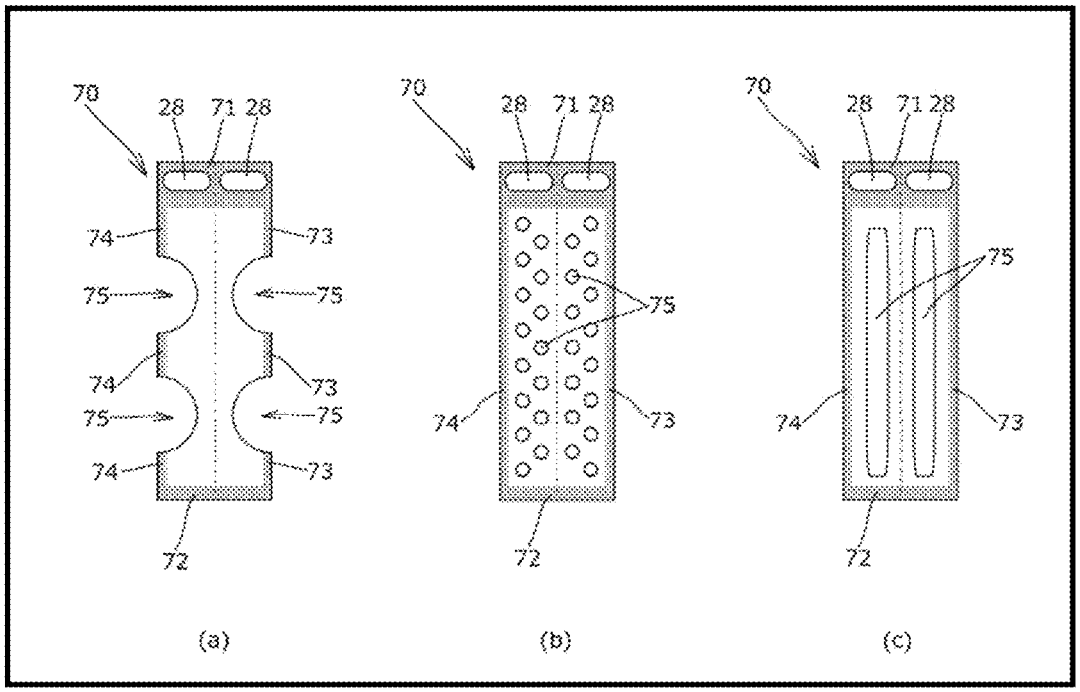
FIG. 7 is an explanatory diagram illustrating various modified examples of an inner supporting member.

Further, in the above-described embodiments and the like, the description is made in which when the circulation portion 75 is formed in the inner supporting member 70, the circulation portion 75 of the inner supporting member 70 is formed in the hole shape. However, a specific mode of the circulation portion 75 may be any mode as long as the circulation portion 75 allows the contents to flow. For example, as illustrated in FIG. 7(*a*), the circulation portion 75 may be formed in a cutout shape obtained by cutting away the outer edge of the inner supporting member 70.

Further, in the example illustrated in FIG. 3, the plurality of circular hole-shaped circulation portions 75 are arranged in two rows, but when the circulation portion 75 is formed in the hole shape, a specific number, arrangement, and shape of the circulation portion 75 may be any number, arrangement, or shape. For example, as illustrated in FIG. 7(*b*), the plurality of circular hole-shaped circulation portions 75 may be disposed in a staggered manner, or further, the circulation portion 75 may be formed in a long hole shape as illustrated in FIG. 7(*c*). Further, the circulation portion 75 may have a mesh shape (not illustrated) provided with fine pores through which the contents circulate.

Note that, for example, as in examples illustrated in FIG. 8(*d*) and FIG. 8(*e*) described below, when the interior of the content containing portion 21 is not divided into the plurality of spaces by the inner supporting member 70, as is described in the present embodiment, that is, when a gap is formed for circulating the contents between the inner supporting member 70 and the inner side surface (each of the films 30 to 50) of the content containing portion 21, the circulation portion 75 need not necessarily be formed.

Further, in the embodiments described above, the description is made in which the first fixture portion 24 of the pouch main body 20 is a part of the sealing portion 23 on the top side, and the second fixture portion 25 is a part of the sealing portion 23 on the bottom side. However, specific positions of the first fixture portion 24 and the second fixture portion 25 may be any positions, as long as a positional relationship is obtained in which the first fixture portion 24 and the second fixture portion 25 face each other across the content containing portion 21. The positions can be modified as appropriate depending on a desired effect of suppressing the body bulging of the pouch main body 20. For example, as in the modified examples illustrated in FIGS. 8(*d*) and 8(*e*) described below, the first fixture portion 24 may be a part of the inner side surface of the front side film 30, and the second fixture portion 25 may be a part of the inner side surface of the rear side film 40. Further, the first fixture portion 24 may be a part of the inner side surface of one of the gusset films 50, and the second fixture portion 25 may be a part of the inner side surface of the other gusset film 50.

Further, in a similar manner, in the embodiments described above, the third fixture portion 26 of the pouch main body 20 is a part of the inner side surface of the front side film 30, and the fourth fixture portion 27 is a part of the inner side surface of the rear side film 40. However, specific positions of the third fixture portion 26 and the fourth fixture portion 27 may be any positions, as long as a positional relationship is obtained in which the third fixture portion 26 and the fourth fixture portion 27 face each other across the content containing portion 21.

Further, a specific number or arrangement of the inner supporting member 70 and a fixing mode for each of the films 30, 40, and 50 may be any number, arrangement, and mode, as long as the first fixing portion 71 and the second fixing portion 72 are included.

Figure 8:
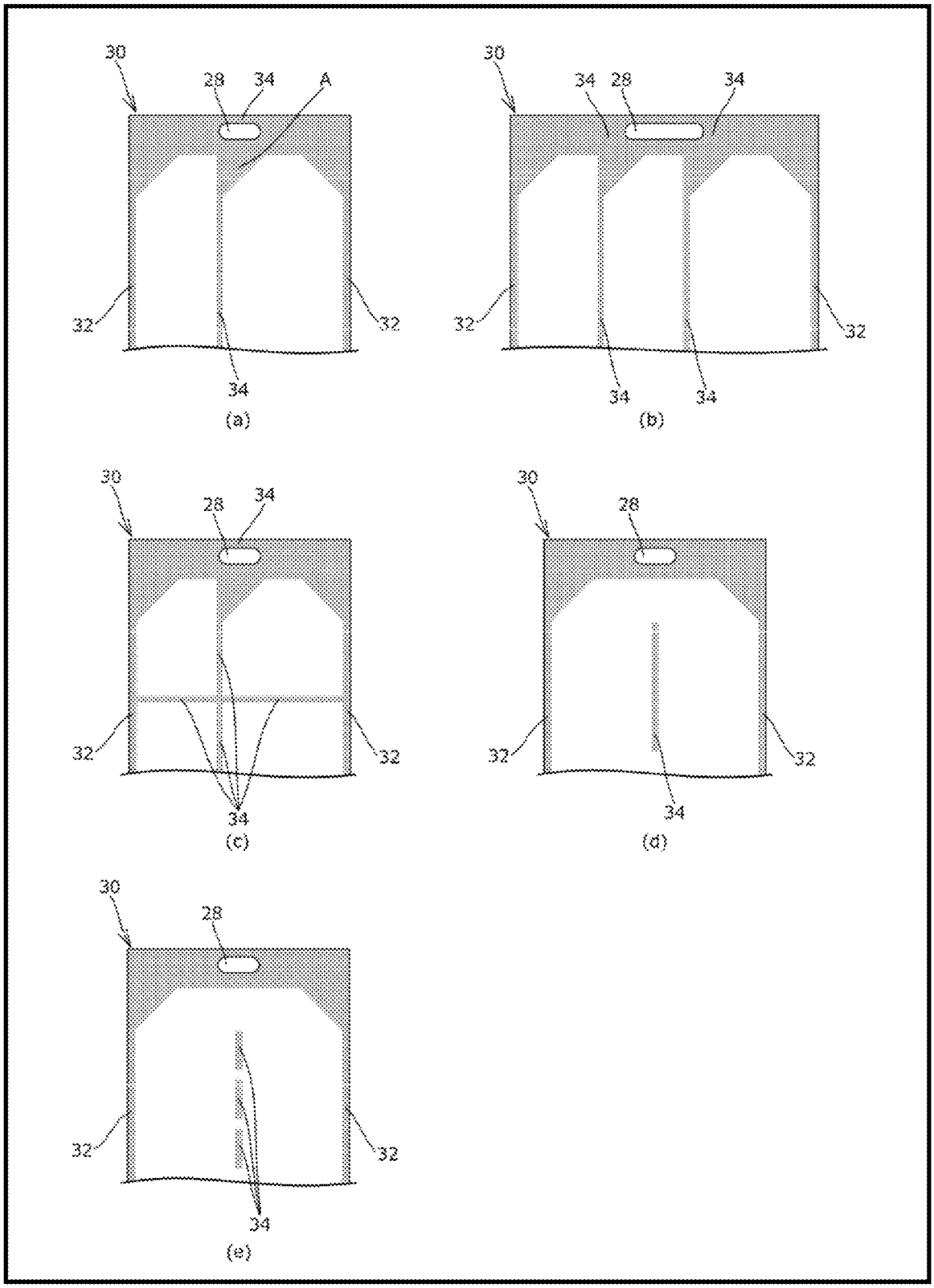
FIG. 8 is an explanatory diagram illustrating various modified examples of an attachment mode of the inner supporting member.

For example, in an example illustrated in FIG. 8(*a*), compared to the example illustrated in FIG. 6, a fixing area of the inner supporting member 70 with respect to each of the films 30 and 40 is larger by an amount corresponding to a section A, and a fixing strength of the inner supporting member 70 with respect to each of the films 30 and 40 can be improved. Note that the modes of the pouch main body 20 and the inner supporting member 70 in the example illustrated in FIG. 8(*a*) are the same as in the example illustrated in FIG. 6, except for the above-described section A.

Further, in an example illustrated in FIG. 8(*b*), two of the inner supporting members 70 are disposed side-by-side in the horizontal direction, and each of the inner supporting members 70 is fixed to the films 30 and 40. Note that the modes of the pouch main body 20 and the inner supporting members 70 in the example illustrated in FIG. 8(*b*) are the same as in the example illustrated in FIG. 8(*a*), except for the number of the inner supporting members 70.

Further, in an example illustrated in FIG. 8(*c*), the inner supporting member 70 is configured by a first film portion (not illustrated) formed in the same manner as the inner supporting member 70 in the example illustrated in FIG. 8(*a*), and a second film portion (not illustrated) formed so as to intersect the first film portion (not illustrated) in a cross shape (in an integrated manner, or separately). The second film portion (not illustrated) is fixed to the inner surface of the front side film 30, the inner surface of the rear side film 40, and the inner surfaces of the left and right pair of gusset films 50. Further, the circulation portion 75 is formed. Note that the modes of the pouch main body 20 and the inner supporting member 70 in the example illustrated in FIG. 8(*c*) are the same as in the example illustrated in FIG. 8(*a*), except that the inner supporting member 70 includes the second film portion (not illustrated).

Further, in the examples illustrated in FIG. 8(*d*) and FIG. 8(*e*), one or a plurality of the inner supporting members 70 includes first and second fixing portions (not illustrated) that are respectively fixed to the inner surface of the front side film 30 and the inner surface of the rear side film 40. Note that the modes of the pouch main body 20 and the inner supporting member 70 in the examples illustrated in FIG. 8(*d*) and FIG. 8(*e*) are the same as in the example illustrated in FIG. 8(*a*), except for the mode of the inner supporting member 70, or the like. For example, by providing the thermal fusing layer on one surface of the inner supporting member 70, the thermal fusing layer can be fixed to the inner surface of the front side film 30 and the inner surface of the rear side film 40.

Further, although not illustrated, in the examples illustrated in FIG. 1 to FIG. 4 or the examples illustrated in FIG. 5 and FIG. 6, the third fixing portion 73 and the fourth fixing portion 74 need not necessarily be provided on the inner supporting member 70. In other words, the inner supporting member 70 may be fixed to the pouch main body 20 by the first fixing portion 71 and the second fixing portion 72 only.

Figure 9:
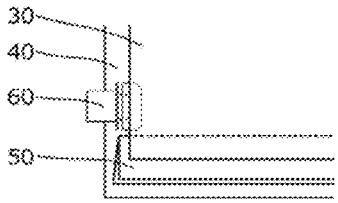
FIG. 9 is an explanatory diagram illustrating an example of an attachment mode of a gusset film.

Further, in the examples illustrated in FIG. 1 to FIG. 3, as illustrated in FIG. 9, the gusset film 50 is folded in two, is disposed between the front side film 30 and the rear side film 40 in a state in which the folded over portion is directed toward the content containing portion 21, and is thermally fused to the front side film 30 and the rear side film 40.

Figure 10:
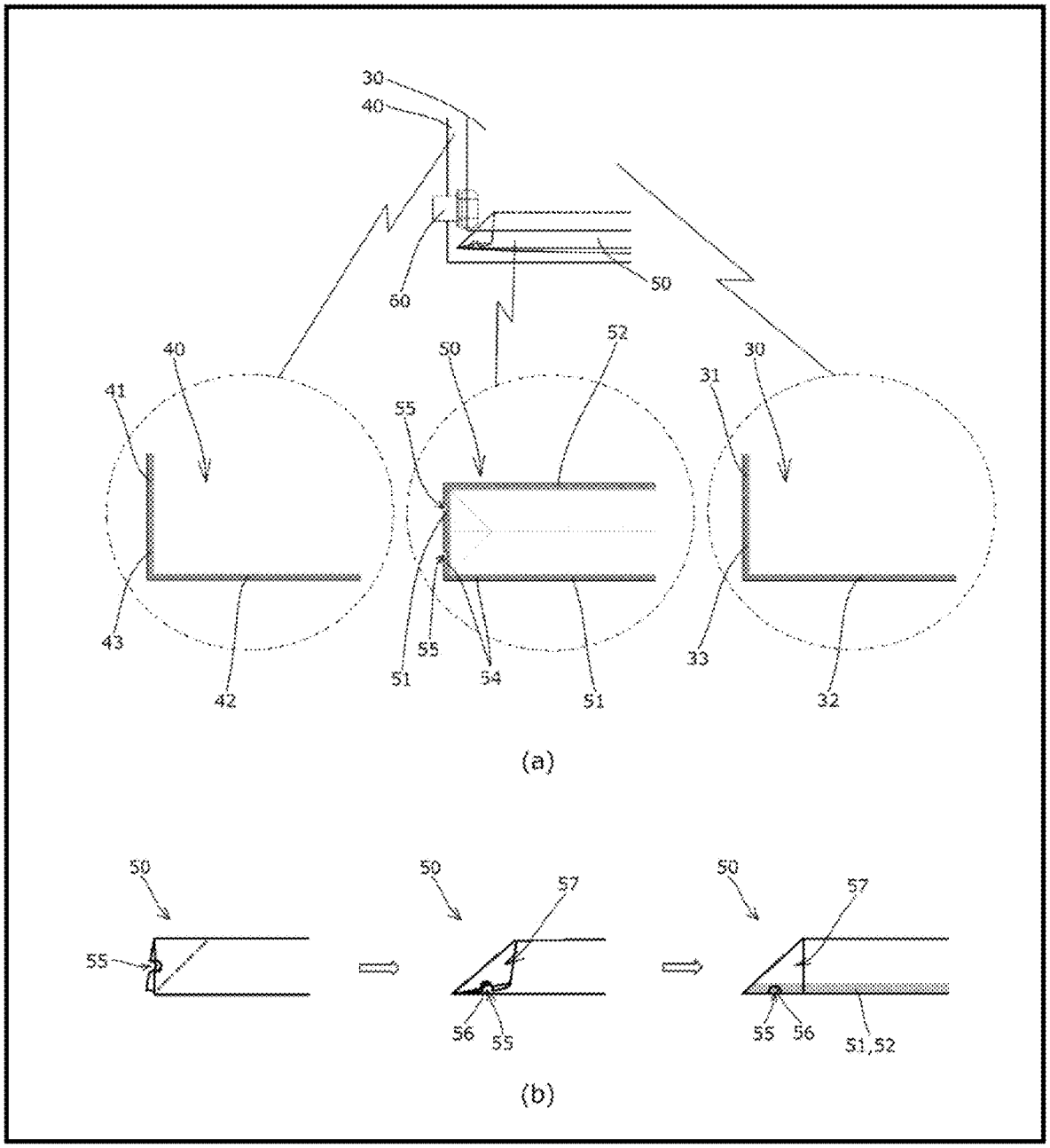
FIG. 10 is an explanatory diagram illustrating a modified example of an attachment mode of the gusset film.
Figure 11:
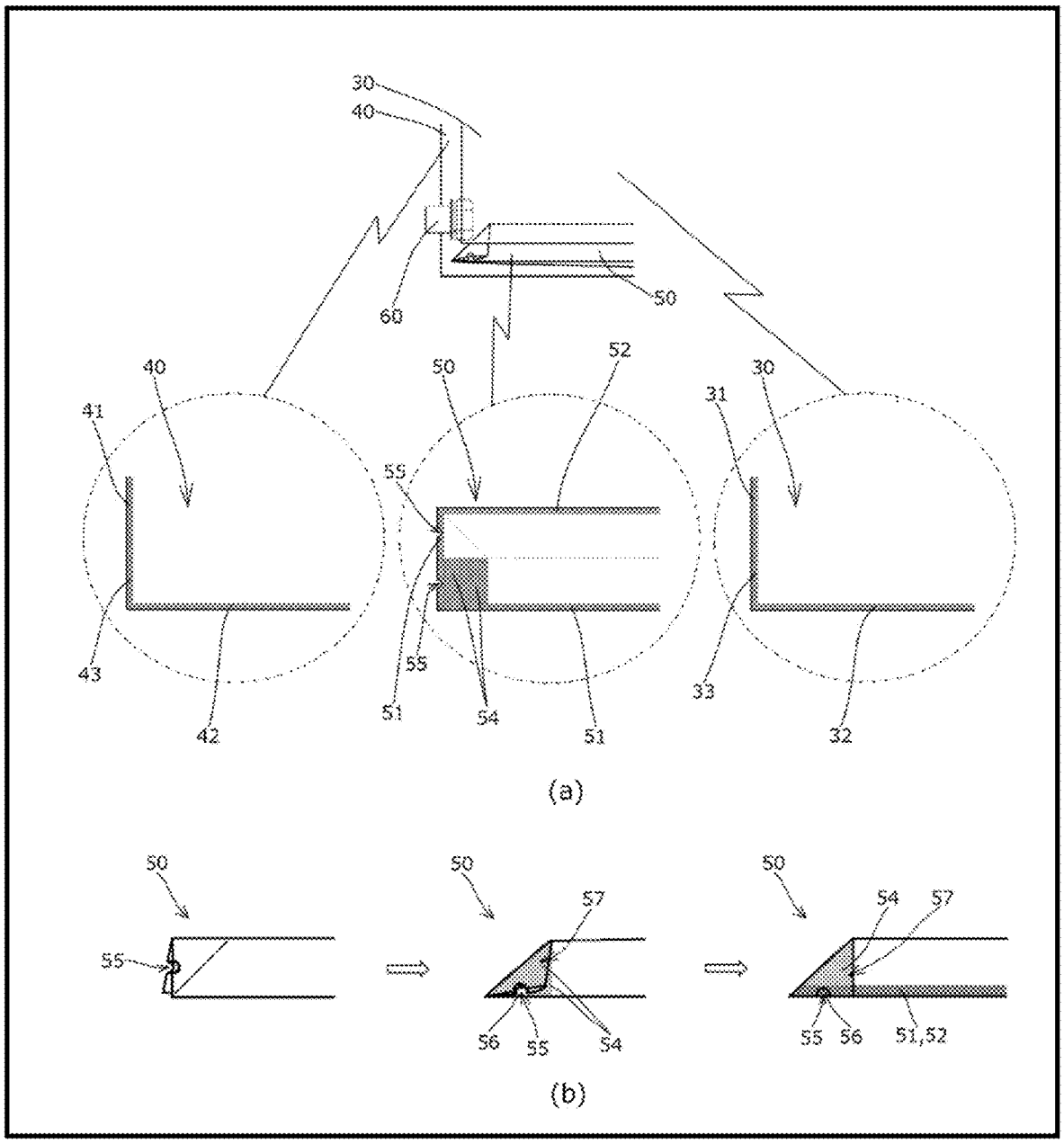
FIG. 11 is an explanatory diagram illustrating a different modified example of the attachment mode of the gusset film.

However, as in modified examples illustrated in FIG. 10 and FIG. 11, at least one of both end portions in the lengthwise direction of the gusset film 50 (in the present modified example, the end portion on the top side near a position where the spout 60 is attached) may be folded diagonally (at an angle of 45° in the present modified example) with respect to the lengthwise direction of the gusset film 50, so that the corner of the gusset film 50 positioned on a side of the content containing portion 21 approaches the outside of the pouch main body 20. Alternatively, the end portion of the gusset film 50 may be folded so that the corner enters between surfaces including the fold of the gusset film that is folded in two. In this way, as illustrated in FIG. 10 and FIG. 11, the spout 60 can be disposed close to end by disposing the spout 60 in a space formed by folding the gusset film 50 diagonally. Thus, when the pouch 10 is placed on the placement surface in a state in which the top portion of the pouch 10 to which the spout 60 is attached is directed horizontally during the use of the pouch 10, the spout 60 can be disposed at a lower position, and this can suppress the fact that a large quantity of the contents remains inside the pouch 10.

Note that in FIG. 10 and FIG. 11, a reference numeral 54 denotes a fourth thermal fusing region 54 for thermally fusing partial portions of the gusset film 50 to each other, which are folded over and facing each other, to each other.

Further, in the examples illustrated in FIG. 10 and FIG. 11, the gusset film 50 includes two penetration portions 55 having a cutout shape on the short side thereof, and the two penetration portions 55 are formed so as to overlap with each other when the gusset film 50 is folded. When the penetration portions 55 are formed in this way, as can be seen in FIG. 10(*b*) and FIG. 11(*b*), one of the front side film 30 or the rear side film 40 (the front side film 30 in the example illustrated in FIG. 10 and FIG. 11) and a portion of the gusset film 50 indicated by a reference numeral 56 can be thermally fused to each other through the penetration portions 55. Note that, although not illustrated, the penetration portion 55 may be formed in a hole shape rather than a cutout shape, and in this case, the penetration portion 55 is formed in the vicinity of the short side of the gusset film 50. Further, the number of penetration portions 55 is not limited to two, and may be four, six, or the like, for example.

Further, as in the example illustrated in FIG. 11, in a triangular-shaped portion 57 formed by further diagonally folding the gusset film 50 that has been folded in two, the gusset film 50 may be thermally fused together. In this case, after the pouch 10 has been formed as a bag, it is possible to prevent the contents from entering between the folded over gusset film 50. Note that in the example illustrated in FIG. 11, at a stage prior to the thermal fusing of the gusset film 50 to the front side film 30 or the rear side film 40, the gusset film 50 is thermally fused together at the portion 57.

Note that the thermal fusing locations between the front side film 30, the rear side film 40, and the gusset film 50 are not limited to the example illustrated in FIG. 10 or the example illustrated in FIG. 11, and may be set as desired according to the embodiment.

Note that the terms "top portion", "bottom portion", "side portion" and the like indicating up and down directions are used herein, but these terms do not limit the orientation of the placement of the pouch 10 during use or during display, transportation, and the like. For example, the pouch 10 may be placed on the placement surface with the side portion or the top portion of the pouch 10 directed downward during the use, display, transportation, and the like.

REFERENCE SIGNS LIST

10 Pouch
20 Pouch main body
21 Content containing portion
22 Gusset portion
23 Sealing portion
24 First fixture portion
25 Second fixture portion
26 Third fixture portion
27 Fourth fixture portion
28 Handle hole
29 Handle portion
29*a* Penetration slit
29*b* Handle tab
29*c* Folding connection portion
29*d* Both end portions
30 Front side film
31 First thermal fusing region
32 Second thermal fusing region
33 Third thermal fusing region
34 Fourth thermal fusing region
35 Creased portion
35*a* First creased portion
35*b* Second creased portion
40 Rear side film
41 First thermal fusing region
42 Second thermal fusing region
43 Third thermal fusing region
44 Fourth thermal fusing region
45 Creased portion
45*a* First creased portion
45*b* Second creased portion
50 Gusset film
51 First thermal fusing region
52 Second thermal fusing region
53 Third thermal fusing region
54 Fourth thermal fusing region
55 Penetration portion
56 Creased portion
60 Spout
70 Inner supporting member
71 First fixing portion
72 Second fixing portion
73 Third fixing portion
74 Fourth fixing portion
75 Circulation portion
76 Weakened portion
77 Filling nozzle
80 Baffle plate
90 Thermal fusing jig
91 Fluid containing portion
92 Hanging portion
C Contents

The invention claimed is:

1. A pouch including a gusset portion, the pouch comprising:

a pouch main body; and an inner supporting member disposed inside the pouch main body, wherein the pouch main body includes a content containing portion, and a first fixture portion and a second fixture portion facing each other across the content containing portion, and the inner supporting member includes a first fixing portion fixed to the first fixture portion and a second fixing portion fixed to the second fixture portion, at the sealing portion, the first fixing portion is disposed between the front side film and the rear side film and is thermally fused to the front side film and the rear side film, an upper part of the sealing portion is formed with a handle hole such that the handle hole is located at a top portion of the pouch main body, and at least a portion of the handle hole is formed extending through a section where the front side film, the rear side film, and the first fixing portion overlap.

2. The pouch according to claim 1, wherein the inner supporting member includes a circulation portion having a hole shape or a cutout shape and configured to allow contents to circulate.

3. The pouch according to claim 1, wherein the inner supporting member is formed from a resin film including a thermal fusing layer, the first fixing portion is fixed to the first fixture portion by thermal fusing, and the second fixing portion is fixed to the second fixture portion by thermal fusing.

4. The pouch according to claim 3, wherein the pouch main body includes a front side film and a rear side film, and a sealing portion configured to allow the pouch main body to be formed in a bag-like shape, and at the sealing portion, at least one of the first fixing portion or the second fixing portion is disposed between the front side film and the rear side film and is thermally fused to the front side film and the rear side film.

5. The pouch according to claim 4, wherein at least one of the first fixing portion or the second fixing portion is, in a state of being folded in two such that the thermal fusing layer faces the front side film and the rear side film, is disposed between the front side film and the rear side film.

6. The pouch according to claim 1, wherein the pouch main body includes a third fixture portion and a fourth fixture portion facing each other across the content containing portion, and the inner supporting member includes a third fixing portion fixed to the third fixture portion and a fourth fixing portion fixed to the fourth fixture portion.

7. The pouch according to claim 6, wherein the inner supporting member is formed from a resin film including a thermal fusing layer, the pouch main body includes a front side film and a rear side film, and a sealing portion configured to allow the pouch main body to be formed in a bag-like shape, at the sealing portion, the first fixing portion and the second fixing portion are, in a state of being folded in two such that the thermal fusing layer faces the front side film and the rear side film, disposed between the front side film and the rear side film, and are thermally fused to the front side film and the rear side film, the third fixing portion is thermally fused to an inner side surface of the front side film, and the fourth fixing portion is thermally fused to an inner side surface of the rear side film.

8. The pouch according to claim 1, wherein the pouch main body includes a front side film and a rear side film, and a sealing portion configured to allow the pouch main body to be formed in a bag-like shape, the first fixing portion is fixed to an inner side surface of the front side film, and the second fixing portion is fixed to an inner side surface of the rear side film.

9. The pouch according to claim 1, wherein the pouch main body includes a front side film, a rear side film, and a gusset film, the gusset film is disposed between the front side film and the rear side film in a state of being folded in two with a folded over portion of the gusset film directed toward the content containing portion, and at least one of both end portions in a lengthwise direction of the gusset film, the gusset film is folded diagonally with respect to the lengthwise direction, such that a corner portion of the gusset film positioned on a side of the content containing portion approaches the outside of the pouch main body.

10. The pouch according to claim 1, wherein at a predetermined location of a film constituting the pouch main body, a creased portion configured to allow folding to more easily occur by deforming the film into a projection-recess shape in a thickness direction of the film is formed.

11. The pouch according to claim 10, wherein the pouch includes a spout attached to the pouch main body, the handle hole is formed at a position at which the handle hole is hooked on the spout in a case where the films are bent at the creased portion.

12. A pouch including a gusset portion, the pouch comprising:

a pouch main body having a content containing portion therein; and an inner supporting member disposed inside the pouch main body so as to divide the content containing portion into a plurality of spaces, a hole shape or a cutout shape beind formed at the inner supporting member such that contents contained in the content containing portion are allowed to flow between the plurality of spaces, wherein a first fixture portion and a second fixture portion facing each other across the content containing portion, and the inner supporting member includes a first fixing portion fixed to the first fixture portion and a second fixing portion fixed to the second fixture portion, and in addition to the hole shape or the cutout shape, a weakened portion having a weaker strength than a strength of a peripheral section is formed at the inner supporting member itself or a fixing portion between the pouch main body and the inner supporting member inside the pouch main body.

13. A pouch including a gusset portion, the pouch comprising:

a pouch main body; and an inner supporting member disposed inside the pouch main body, wherein the pouch main body includes a content containing portion, and a first fixture portion and a second fixture portion facing each other across the content containing portion, and the inner supporting member includes a first fixing portion fixed to the first fixture portion and a second fixing portion fixed to the second fixture portion, and a fluid containing portion containing a fluid in an encapsulated state is formed at a fixing region between a film constituting the pouch main body and a film constituting the inner supporting member, the fixing region and the fluid containing portion extending in a vertical direction.

14. The pouch according to claim 1, wherein the inner supporting member is configured to divide the content containing portion into a plurality of spaces, and the inner supporting member is formed with a circulation portion configured to allow the plurality of spaces to communicate with each other.

15. The pouch according to claim 1, wherein the pouch main body includes a sealing portion formed by thermally fusing films constituting the pouch main body to each other, the sealing portion is formed with a penetration slit extending through the films in a front-rear direction and a handle tab divided from a peripheral section by the penetration slit, and a part of an outer edge of the handle tab is connected to the peripheral section by a folding connection portion.

16. The pouch according to claim 1, wherein the inner supporting member is installed to completely separate the content containing portion into a plurality of spaces.

17. The pouch according to claim 1, wherein a hanging portion configured to allow the pouch to be suspended and used is formed at the pouch main body, and a spout is attached at a position that is a lower side of the pouch in a state in which the pouch is suspended using the hanging portion.

* * * * *